US011026451B2

(12) United States Patent
Wensley et al.

(10) Patent No.: US 11,026,451 B2
(45) Date of Patent: Jun. 8, 2021

(54) ELECTRONIC CIGARETTE FLUID PUMP

(71) Applicant: Fontem Holdings 1 B.V., Amsterdam (NL)

(72) Inventors: Martin Wensley, Los Gatos, CA (US); Khe Kubel, San Mateo, CA (US); Stefan Biel, Hamburg (DE); Mark Brinkerhoff, Campbell, CA (US); Tom Geraty, San Jose, CA (US); Reynaldo Quintana, Campbell, CA (US)

( * ) Notice: Subject to any disclaimer, the term of this patent is extended or adjusted under 35 U.S.C. 154(b) by 268 days.

(21) Appl. No.: 15/994,680

(22) Filed: May 31, 2018

(65) Prior Publication Data

US 2018/0343925 A1 Dec. 6, 2018

Related U.S. Application Data

(60) Provisional application No. 62/513,865, filed on Jun. 1, 2017.

(51) Int. Cl.

| | |
|---|---|
| ***A24F 47/00*** | (2020.01) |
| *F04B 43/04* | (2006.01) |
| *F04B 45/047* | (2006.01) |
| *H05B 3/44* | (2006.01) |

(52) U.S. Cl.

CPC ..... *A24F 47/008* (2013.01); *F04B 43/043* (2013.01); *F04B 45/047* (2013.01); *H05B 3/44* (2013.01)

(58) Field of Classification Search

CPC ..... A24F 40/48; A24F 47/008

See application file for complete search history.

(56) References Cited

U.S. PATENT DOCUMENTS

| | | | | |
|---|---|---|---|---|
| 8,511,318 | B2 | 8/2013 | Hon | |
| 2011/0265806 | A1* | 11/2011 | Alarcon | A24F 47/00 131/273 |
| 2013/0183170 | A1 | 7/2013 | Laermer | |
| 2014/0144429 | A1 | 5/2014 | Wensley et al. | |
| 2014/0190496 | A1 | 7/2014 | Wensley et al. | |
| 2015/0164143 | A1* | 6/2015 | Maas | A24F 47/008 131/329 |
| 2015/0196060 | A1 | 7/2015 | Wensley et al. | |
| 2015/0201675 | A1* | 7/2015 | Lord | A61M 11/042 131/329 |
| 2015/0216237 | A1* | 8/2015 | Wensley | A24F 47/008 131/273 |
| 2016/0366946 | A1* | 12/2016 | Murison | H05B 1/0297 |
| 2017/0020192 | A1* | 1/2017 | Fregonese | H05B 3/0014 |
| 2017/0055583 | A1* | 3/2017 | Blandino | H05B 6/36 |
| 2018/0230989 | A1* | 8/2018 | Minoguchi | F04B 53/10 |

FOREIGN PATENT DOCUMENTS

| | | | |
|---|---|---|---|
| CN | 101524187 | B | 12/2010 |
| CN | 104824846 | A | 8/2015 |
| WO | 2015066121 | A1 | 5/2015 |
| WO | 2015077645 | A1 | 5/2015 |

* cited by examiner

*Primary Examiner* — Eric Yaary

(74) *Attorney, Agent, or Firm* — Dykema Gossett PLLC

(57) ABSTRACT

Aspects of the instant disclosure relate to electronic cigarettes with an active delivery system for transporting a liquid solution from a tank to an atomizer; and more particularly to oscillating diaphragm pumps that facilitate flow of the liquid solution from the tank and onto a heating coil of an atomizer for vaporization.

14 Claims, 14 Drawing Sheets

ELECTRONIC CIGARETTE FLUID PUMP

CROSS-REFERENCE TO RELATED APPLICATION

This application claims the benefit of U.S. provisional application No. 62/513,865, filed 1 Jun. 2017, which is hereby incorporated by reference as though fully set forth herein.

BACKGROUND

Field

The present disclosure relates to electronic cigarettes; more specifically, to electronic cigarettes with an active delivery system for transporting a liquid solution from a tank to an atomizer.

Background Art

Electronic cigarettes, also known as e-cigarettes (eCigs) and personal vaporizers (PVs), are electronic inhalers that vaporize or atomize a liquid solution into an aerosol mist, which is inhaled by a user. A typical rechargeable eCig has two main parts—a battery housing and a cartomizer. The battery housing typically includes a battery, a light emitting diode (LED), and a pressure sensor. The cartomizer typically includes a liquid solution, an atomizer, and a mouthpiece. The atomizer typically includes a heating coil that vaporizes the liquid solution.

To recharge the battery, a universal serial bus (USB) charger can be utilized which draws power from a computer or other power supply, converts the supplied power to the desired input for the battery, and supplies the desired input to the battery. In use, a user draws air through the atomizer, via the mouthpiece, to activate a heating coil that vaporizes the liquid solution into the air being drawn. After a number of draws, the battery must be recharged. Similarly, after a number of draws, the liquid solution within the cartomizer is depleted and must be replaced with another cartomizer.

BRIEF SUMMARY

Aspects of the present disclosure are directed to electronic cigarettes with an active delivery system for transporting a liquid solution (such as eCig juice) from a tank to an atomizer. Specifically, various embodiments of the present disclosure are directed to oscillating diaphragm pumps that facilitate flow of the liquid solution from the tank within a cartomizer to the atomizer and onto a heating coil for vaporization.

Various aspects of the present disclosure are directed to an electronic cigarette including a tank containing eCig juice, an atomizer, and an oscillating diaphragm pump. The atomizer includes a heating element, and vaporizes eCig juice into an airflow. The oscillating diaphragm pump includes a diaphragm and a permanent magnet. The oscillating diaphragm pump is positioned in fluid communication with the tank and the atomizer, and draws eCig juice from the tank and deposits the eCig juice on to the heating element. In more specific embodiments, the electronic cigarette further includes an electro-magnet that transmits an oscillating magnetic field in proximity to the permanent magnet. The permanent magnet produces a non-oscillating magnetic field that interacts with the oscillating magnetic field of the electro-magnet to linearly oscillate the diaphragm drawing eCig juice from the tank and injecting the eCig juice on to the heating element.

Other embodiments of the present disclosure are directed to an oscillating diaphragm pump that includes a diaphragm, a permanent magnet, and inlet and outlet valves. The diaphragm includes a deformable membrane, an inlet, and an outlet, and expands and contracts to pump a liquid solution through the oscillating diaphragm pump. The permanent magnet is coupled to the diaphragm, and produces a non-oscillating magnetic field that interacts with an oscillating magnetic field to sequentially attract and repel the permanent magnet, thereby expanding and contracting the diaphragm at the deformable membrane. The inlet valve is in fluid communication with the inlet of the diaphragm, and the outlet valve is in fluid communication with the outlet of the diaphragm. The inlet and outlet valves act to prevent reverse flow of the liquid solution through the oscillating diaphragm pump. In some specific embodiments, the oscillating diaphragm pump further includes an upper housing and a lower housing. The upper housing contains the outlet valve and the lower housing contains the inlet valve. At least one of the upper and lower housing may include a support member that circumferentially extends around at least a portion of one or both of the inlet and outlet valves. The support member stiffens one or both of the inlet and outlet valves to reduce back flow.

Additional features, advantages, and embodiments of the disclosure may be set forth or apparent from consideration of the detailed description and drawings. Moreover, it is to be understood that the foregoing summary of the disclosure and the following detailed description and drawings are exemplary and intended to provide further explanation without limiting the scope of the disclosure as claimed.

BRIEF DESCRIPTION OF THE DRAWINGS

Various example embodiments may be more completely understood in consideration of the following detailed description in connection with the accompanying drawings.

Figure 1:
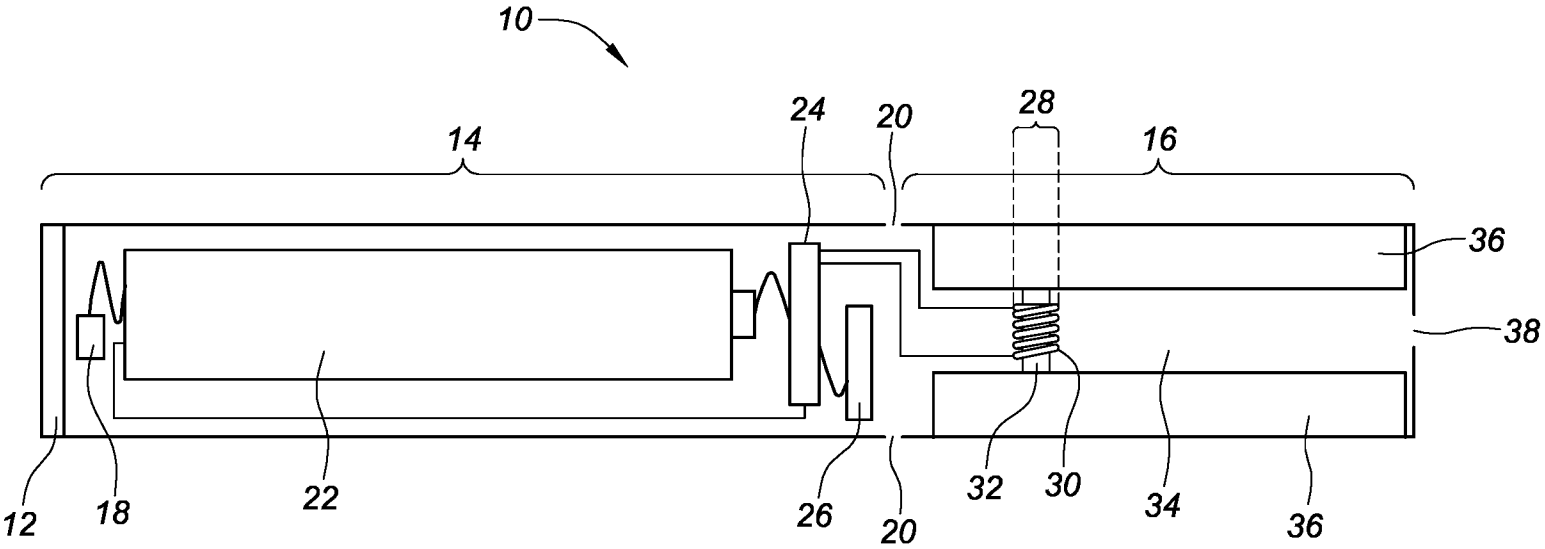
FIG. 1 is a schematic cross-sectional illustration of an exemplary e-cigarette, consistent with various aspects of the present disclosure.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

Throughout the following, an electronic smoking device will be exemplarily described with reference to an e-cigarette. As is shown in FIG. 1, an e-cigarette 10 typically has a housing comprising a cylindrical hollow tube having an end cap 12. The cylindrical hollow tube may be a single-piece or a multiple-piece tube. In FIG. 1, the cylindrical hollow tube is shown as a two-piece structure having a power supply portion 14 and an atomizer/liquid reservoir portion 16. Together the power supply portion 14 and the atomizer/liquid reservoir portion 16 form a cylindrical tube which can be approximately the same size and shape as a conventional cigarette, typically about 100 millimeters ("mm") with a 7.5 mm diameter, although lengths may range from 70 to 150 or 180 mm, and diameters from 5 to 28 mm.

The power supply portion 14 and atomizer/liquid reservoir portion 16 are typically made of metal (e.g., steel or aluminum, or of hardwearing plastic) and act together with the end cap 12 to provide a housing to contain the components of the e-cigarette 10. The power supply portion 14 and the atomizer/liquid reservoir portion 16 may be configured to fit together by, for example, a friction push fit, a snap fit, a bayonet attachment, a magnetic fit, or screw threads. The end cap 12 is provided at the front end of the power supply portion 14. The end cap 12 may be made from translucent plastic or other translucent material to allow a light-emitting diode (LED) 18 positioned near the end cap to emit light through the end cap. Alternatively, the end cap may be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 14 and the atomizer/liquid reservoir portion 16. FIG. 1 shows a pair of air inlets 20 provided at the intersection between the power supply portion 14 and the atomizer/liquid reservoir portion 16.

A power supply, preferably a battery 22, the LED 18, control electronics 24 and, optionally, an airflow sensor 26 are provided within the cylindrical hollow tube power supply portion 14. The battery 22 is electrically connected to the control electronics 24, which are electrically connected to the LED 18 and the airflow sensor 26. In this example, the LED 18 is at the front end of the power supply portion 14, adjacent to the end cap 12; and the control electronics 24 and airflow sensor 26 are provided in the central cavity at the other end of the battery 22 adjacent the atomizer/liquid reservoir portion 16.

The airflow sensor 26 acts as a puff detector, detecting a user puffing or sucking on the atomizer/liquid reservoir portion 16 of the e-cigarette 10. The airflow sensor 26 can be any suitable sensor for detecting changes in airflow or air pressure, such as a microphone switch including a deformable membrane which is caused to move by variations in air pressure. Alternatively, the sensor may be, for example, a Hall element or an electro-mechanical sensor.

The control electronics 24 are also connected to an atomizer 28. In the example shown, the atomizer 28 includes a heating coil 30 which is wrapped around a wick 32 extending across a central passage 34 of the atomizer/liquid reservoir portion 16. The central passage 34 may, for example, be defined by one or more walls of the liquid reservoir and/or one or more walls of the atomizer/liquid reservoir portion 16 of the e cigarette 10. The coil 30 may be positioned anywhere in the atomizer 28 and may be transverse or parallel to a longitudinal axis of a cylindrical liquid reservoir 36. The wick 32 and heating coil 30 do not completely block the central passage 34. Rather an air gap is provided on either side of the heating coil 30 enabling air to flow past the heating coil 30 and the wick 32. The atomizer may alternatively use other forms of heating elements, such as ceramic heaters, or fiber or mesh material heaters. Nonresistance heating elements such as sonic, piezo, and jet spray may also be used in the atomizer in place of the heating coil.

The central passage 34 is surrounded by the cylindrical liquid reservoir 36 with the ends of the wick 32 abutting or extending into the liquid reservoir 36. The wick 32 may be a porous material such as a bundle of fiberglass fibers or cotton or bamboo yarn, with liquid in the liquid reservoir 36 drawn by capillary action from the ends of the wick 32 towards the central portion of the wick 32 encircled by the heating coil 30.

The liquid reservoir 36 may alternatively include wadding (not shown in FIG. 1) soaked in liquid which encircles the central passage 34 with the ends of the wick 32 abutting the wadding. In other embodiments, the liquid reservoir may comprise a toroidal cavity arranged to be filled with liquid and with the ends of the wick 32 extending into the toroidal cavity.

An air inhalation port 38 is provided at the back end of the atomizer/liquid reservoir portion 16 remote from the end cap 12. The inhalation port 38 may be formed from the cylindrical hollow tube atomizer/liquid reservoir portion 16 or may be formed in an end cap.

In use, a user sucks on the e-cigarette 10. This causes air to be drawn into the e cigarette 10 via one or more air inlets, such as air inlets 20, and to be drawn through the central passage 34 towards the air inhalation port 38. The change in air pressure which arises is detected by the airflow sensor 26, which generates an electrical signal that is passed to the control electronics 24. In response to the signal, the control electronics 24 activate the heating coil 30, which causes liquid present in the wick 32 to be vaporized creating an aerosol (which may comprise gaseous and liquid components) within the central passage 34. As the user continues to suck on the e-cigarette 10, this aerosol is drawn through the central passage 34 and inhaled by the user. At the same time, the control electronics 24 also activate the LED 18 causing the LED 18 to light up, which is visible via the translucent end cap 12. Activation of the LED may mimic the appearance of a glowing ember at the end of a conventional cigarette. As liquid present in the wick 32 is converted into an aerosol, more liquid is drawn into the wick 32 from the liquid reservoir 36 by capillary action and thus is available to be converted into an aerosol through subsequent activation of the heating coil 30.

Some e-cigarettes are intended to be disposable and the electric power in the battery 22 is intended to be sufficient to vaporize the liquid contained within the liquid reservoir 36, after which the e-cigarette 10 is thrown away. In other embodiments, the battery 22 is rechargeable and the liquid reservoir 36 is refillable. In the cases where the liquid reservoir 36 is a toroidal cavity, this may be achieved by refilling the liquid reservoir 36 via a refill port (not shown in FIG. 1). In other embodiments, the atomizer/liquid reservoir portion 16 of the e cigarette 10 is detachable from the power supply portion 14 and a new atomizer/liquid reservoir portion 16 can be fitted with a new liquid reservoir 36 thereby replenishing the supply of liquid. In some cases, replacing the liquid reservoir 36 may involve replacement of the heating coil 30 and the wick 32 along with the replacement of the liquid reservoir 36. A replaceable unit comprising the atomizer 28 and the liquid reservoir 36 may be referred to as a cartomizer.

The new liquid reservoir may be in the form of a cartridge (not shown in FIG. 1) defining a passage (or multiple passages) through which a user inhales aerosol. In other embodiments, the aerosol may flow around the exterior of the cartridge to the air inhalation port 38.

Of course, in addition to the above description of the structure and function of a typical e cigarette 10, variations also exist. For example, the LED 18 may be omitted. The airflow sensor 26 may be placed, for example, adjacent to the end cap 12 rather than in the middle of the e-cigarette. The airflow sensor 26 may be replaced by, or supplemented with, a switch which enables a user to activate the e cigarette manually rather than in response to the detection of a change in air flow or air pressure.

Different types of atomizers may be used. Thus, for example, the atomizer may have a heating coil in a cavity in the interior of a porous body soaked in liquid. In this design, aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Various aspects of the present disclosure are directed toward a pumping mechanism for electronic cigarette applications. Specifically, a pumping mechanism for delivering eCig juice from a tank to an atomizer for vaporization. To facilitate consistent performance, the pump must operate at a consistent rate regardless of conditions such as temperature and liquid level in the tank. To minimize costs, various embodiments may also include high tolerance parts. Moreover, embodiments of the pump disclosed herein may have minimal mass to prevent the eCig user from feeling a vibration associated with operation of the pump. In some applications, the pump mechanisms may pump at a rate of up to 5 mg/sec of liquid, and/or pump up to 100% vegetable glycerin or Propylene Glycol.

Various pumps in accordance with the present disclosure may include two or more one-way valves which are positioned in-line between an eCig fluid tank and an atomizer. The pumping action takes place in the space between the valves (e.g., a diaphragm), with the diaphragm between the valves expanding and contracting successively to pump eCig juice from the tank to the atomizer. In some embodiments, the pumping action is powered by an oscillating signal generator that drives a wire coil to create an oscillating magnetic field that acts on a permanent magnet that has been coupled to a portion of the pump. In response to the oscillating magnetic field, the diaphragm expands and contracts and thereby causes fluid to move through the pump. Such pumps are often referred to as oscillating diaphragm pumps.

Figure 2:
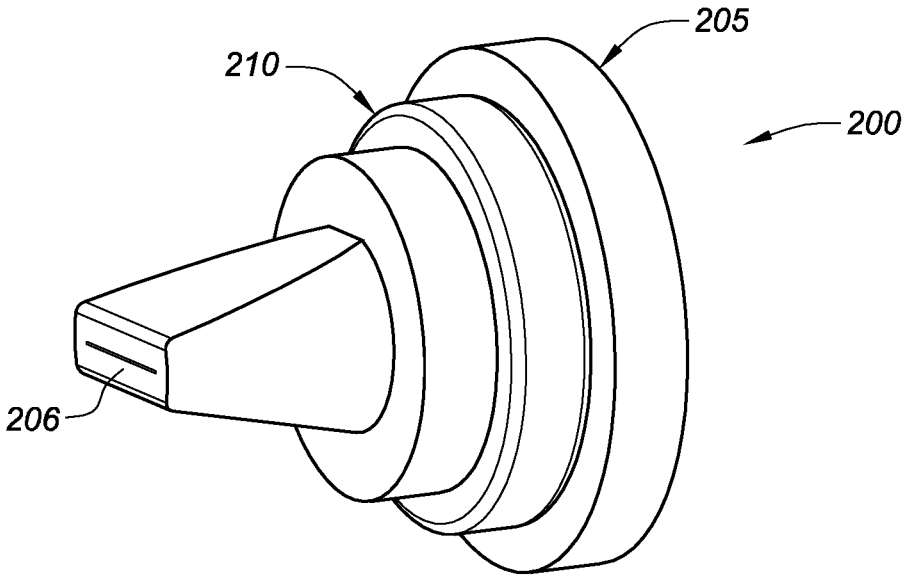
FIG. 2 is an isometric side view of an oscillating diaphragm pump, consistent with various aspects of the present disclosure.

FIG. 2 is an isometric view of an oscillating diaphragm pump 200, consistent with various aspects of the present disclosure. The oscillating diaphragm pump 200 includes a housing 205 that forms a majority of the pump including a deformable membrane and a diaphragm. A ring-shaped permanent magnet 210 is coupled to an exterior of an oscillating portion of the pump 200. In response to an oscillating magnetic field, the permanent magnet 210 causes the oscillating portion of the pump 200 to linearly actuate in a repeating fashion. The deformable membrane, in response to the oscillation changes the volume of the diaphragm within the pump 200, and thereby effects a pressure change therein. The oscillating diaphragm pump may be positioned within an eCig to facilitate the flow of eCig juice from a tank, through an inlet valve of the pump 200 (which may be located in fluid contact with the tank), and out of an outlet valve 206. The outlet valve 206 may be placed in close proximity to a atomizer to facilitate disbursement of the eCig juice onto a heating coil therein.

Figure 3:
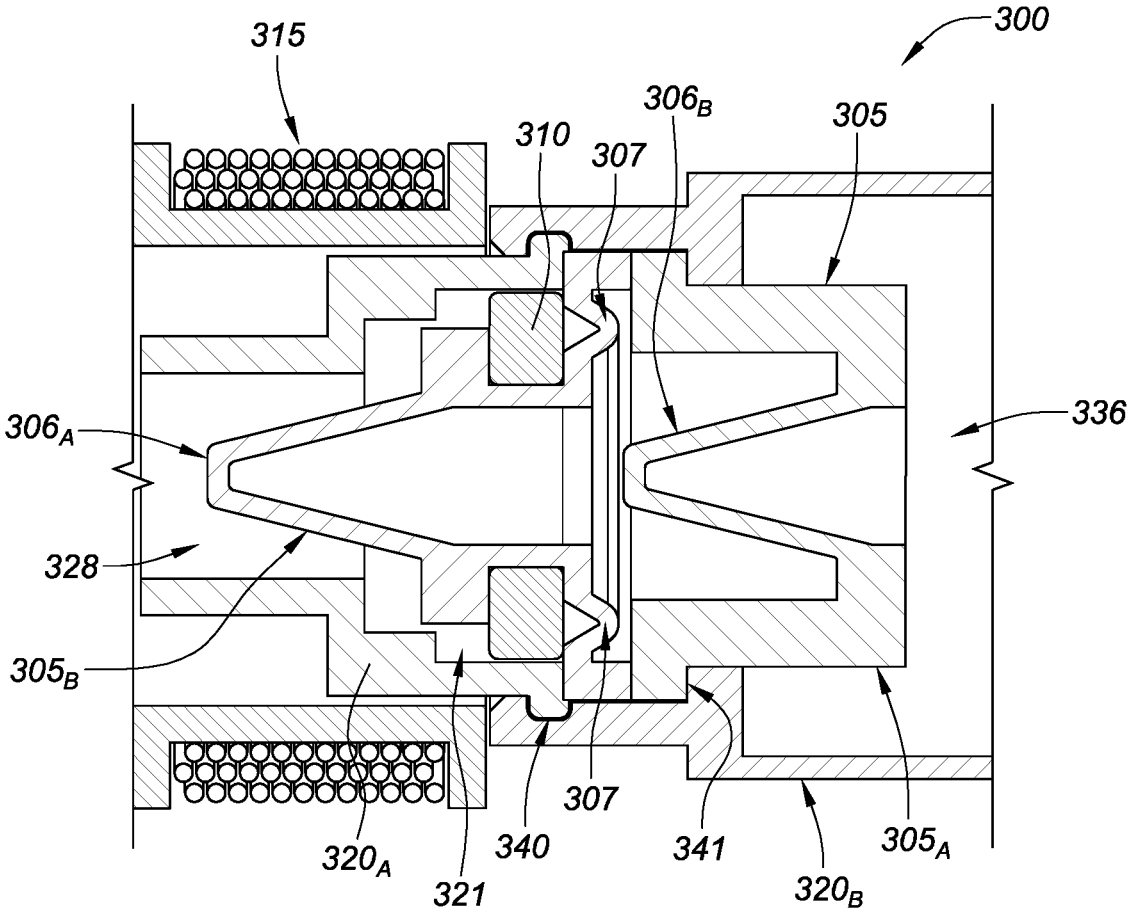
FIG. 3 is a partial cross-sectional side view of an electronic cigarette including an oscillating diaphragm pump, consistent with various aspects of the present disclosure.

FIG. 3 is a partial cross-sectional side view of an electronic cigarette 300 including an oscillating diaphragm pump 305, consistent with various aspects of the present disclosure. The oscillating diaphragm pump 305 is coupled to the rest of the eCig 300 via an upper mount $\mathbf{320}_A$ and a lower mount $\mathbf{320}_B$. The upper mount $\mathbf{320}_A$ facilitates expansion and contraction of deformable membrane 307 (and thereby the diaphragm itself) into and out of the diaphragm expansion region 321. The deformable membrane 307 includes a fold that facilitates movement of upper housing $\mathbf{305}_B$ and permanent magnet 310 relative to lower housing $\mathbf{305}_A$ freely back and forth when exposed to an oscillating magnetic field.

An electro-magnet 315, within eCig 300, may circumferentially surrounds at least a portion of an upper housing $\mathbf{305}_B$ of oscillating diaphragm pump 305. When controller circuitry within the eCig 300 detects a user's draw on the eCig, an oscillating signal generator drives the electro-magnet 315. The electro-magnet 315, in response to the oscillating generator signal, radiates an oscillating magnetic field in proximity to permanent magnet 310. The permanent magnet 310, in response to the magnetic field, exerts a fluctuating force on the oscillating diaphragm pump 305. When the magnetic field emitted from the electro-magnet 315 opposes the magnetic field of the permanent magnet 310, the diaphragm contracts (as facilitated by deformable membrane 307). This increases the pressure within the diaphragm, closing inlet valve $\mathbf{306}_B$ (e.g., a duckbill valve), and opening outlet valve $\mathbf{306}_A$. Accordingly, eCig juice within the pump 305 is propelled into an atomizer chamber 328.

When the magnetic field emitted from the electro-magnet 315 attracts the magnetic field of the permanent magnet 310, the diaphragm expands. This creates a vacuum pressure within the diaphragm, closing outlet valve $\mathbf{306}_A$, and opening inlet valve $\mathbf{306}_B$. The open inlet valve $\mathbf{306}_B$ draws eCig juice from within a liquid reservoir 336 (also referred to as a tank) into the diaphragm.

The pumping process of the oscillating diaphragm pump 305 continues, for example, until controller circuitry within the eCig 300 detects a user's discontinued draw on the eCig, and disables the oscillating signal generator—which thereby dissipates the magnetic field acting on the permanent magnet 310 of the pump 305. In some embodiments, the controller circuitry may be programmed to turn-off the oscillating diaphragm pump 305 after a set time. In other embodiments, the pump may be disabled after the tank has run out of eCig juice, or a current draw from the heating coil (during vaporization) indicates that the heating coil is inundated with eCig juice.

It is to be understood, in the embodiment of FIG. 3, that upper housing $\mathbf{305}_B$ may dynamically expand and contract (due-in-part to deformable membrane 307) within, and relative to, the upper mount $\mathbf{320}_A$. Lower housing $\mathbf{305}_A$, however, is coupled to and held static by lower mount $\mathbf{320}_B$. The permanent magnet 310, as it is coupled to upper housing $\mathbf{305}_B$, moves with the upper housing $\mathbf{305}_B$ in response to the magnetic field produced by electro-magnet 315.

To assemble oscillating diaphragm pump 305 within ecig 300, lower housing $\mathbf{305}_A$ is inserted into lower mount $\mathbf{320}_B$ with shoulder feature 341 limiting the insertion of the lower housing $\mathbf{305}_A$ into the lower mount $\mathbf{320}_B$. An upper housing $\mathbf{305}_B$, including a deformable membrane 307 and a permanent magnet 310 coupled thereto, may then be partially inserted into the lower mount $\mathbf{320}_B$. The deformable membrane 307 is located between the lower and upper housings, $\mathbf{305}_A$ and $\mathbf{305}_B$, respectively. An upper mount $\mathbf{320}_A$ may then be lowered over the upper housing $\mathbf{305}_B$. The upper mount $\mathbf{320}_A$ couples to the lower mount $\mathbf{320}_B$ at interlock 340, which sandwiches the deformable membrane 307 and lower housing $\mathbf{305}_A$ between the shoulder feature 341 of the lower mount $\mathbf{320}_B$ and the upper mount $\mathbf{320}_A$. The resulting assembly facilitates expansion and contraction of the deformable membrane 307 and the upper housing $\mathbf{305}_B$ mounted thereto.

Figure 3A:
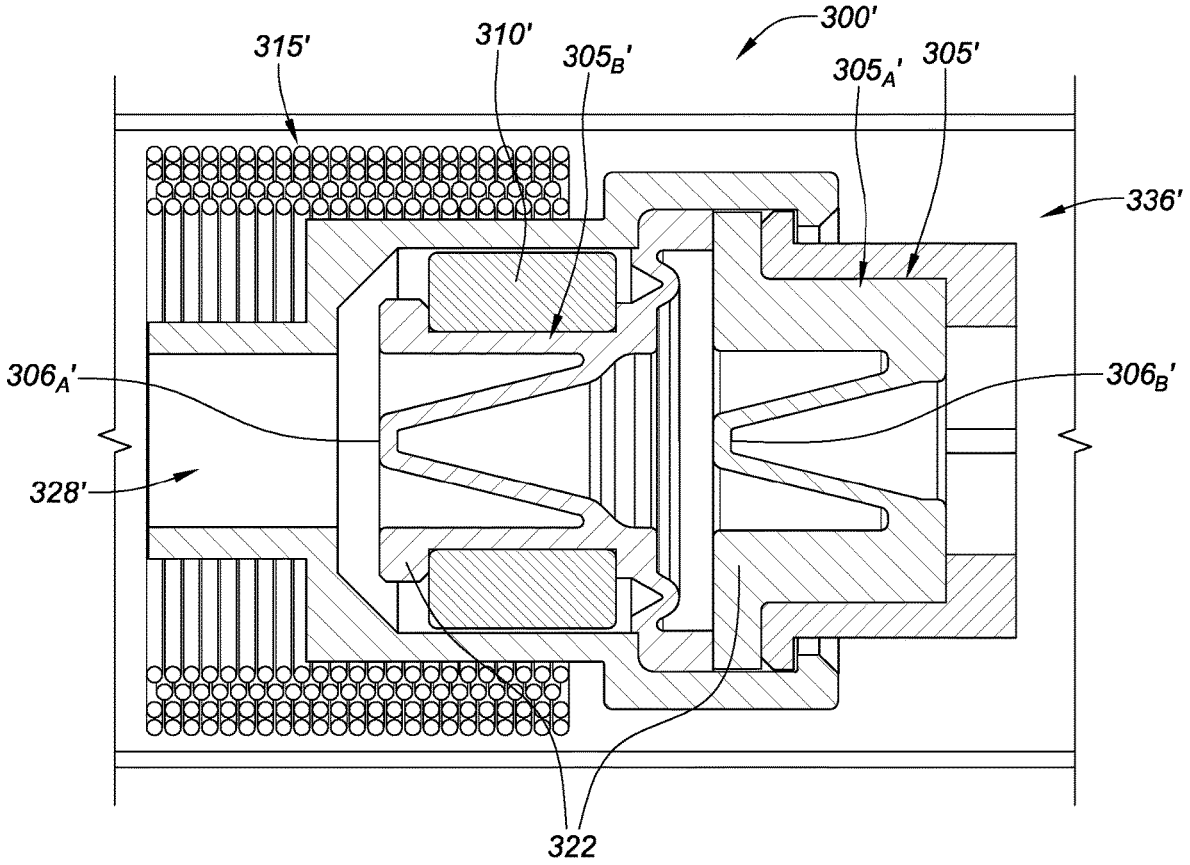
FIG. 3A is a partial cross-sectional side view of an electronic cigarette including an oscillating diaphragm pump, consistent with various aspects of the present disclosure.

FIG. 3A is a partial cross-sectional side view of an electronic cigarette 300' including an oscillating diaphragm pump 305', consistent with various aspects of the present disclosure. Similar to FIG. 3, the present eCig 300' includes an electro-magnet 315' circumferentially extending around at least a portion of the pump 305'. The eCig 300' also delivers eCig juice from a liquid reservoir 336', through an inlet valve $\mathbf{306}_B$', into a diaphragm of the pump 305', through the outlet valve $\mathbf{306}_A$', and into an atomizer chamber 328'. However, in the present embodiment, upper housing 305B' includes a support member 322 (similar to the support member 322 for the lower housing $\mathbf{305}_A$') that circumferentially extends around the outlet valve 306A' and aids in stiffening the outlet valve to reduce back flow. Moreover, the support member 322 facilitates the mounting of a larger permanent magnet 310' to the pump 305'. A larger permanent magnet may facilitate improved pump performance. However, in various embodiments of the present disclosure it is desirable to limit the oscillating mass of the pump 305' to prevent a noticeable vibration of the eCig 300' by the user.

Figure 3B:
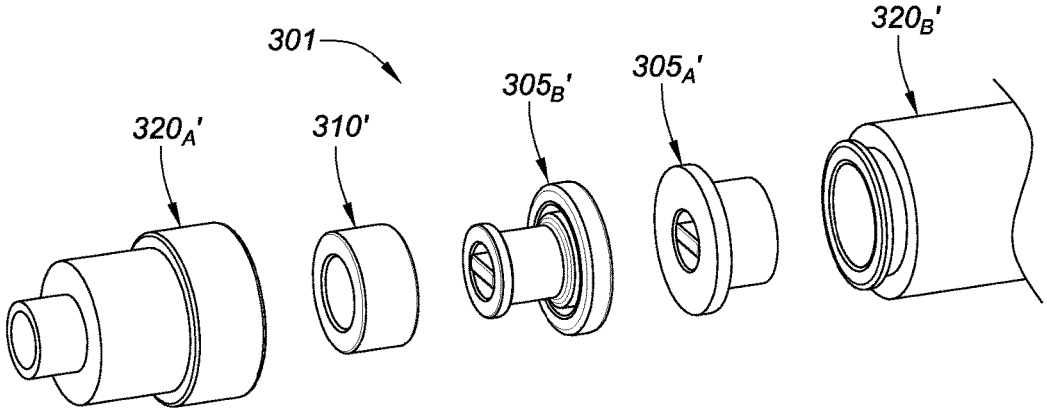
FIG. 3B is an exploded isometric view of an oscillating diaphragm pump assembly for an electronic cigarette, consistent with various aspects of the present disclosure.

FIG. 3B is an exploded isometric view of an oscillating diaphragm pump assembly 301 for an electronic cigarette, consistent with various aspects of the present disclosure. Upper housing $\mathbf{305}_B$' and lower housing $\mathbf{305}_A$' may be held together by the coupling of upper mount $\mathbf{320}_A$' and lower mount $\mathbf{320}_B$'. In other embodiments, the upper and lower housings ($\mathbf{305}_B$' and $\mathbf{305}_A$', respectively) may be coupled using an adhesive, welding process (e.g., ultrasonic welding), or fasteners. In the present embodiment, the upper and lower housing portions are placed within a cavity of the upper mount $\mathbf{320}_A$', and the lower mount $\mathbf{320}_B$' is coupled to the upper mount using snap features on respective portions of the upper and lower mounts. In yet other embodiments, the upper and lower mounts may be coupled via means well known in the arts (e.g., welding, adhesives, fasteners, etc.). A permanent magnet 310', in the present embodiment, may be press fit onto the upper housing portion $\mathbf{305}_B$'. As discussed above, other fastening means may also be used to fasten the permanent magnet 310' to the upper housing portion $\mathbf{305}_B$'.

Figure 4:
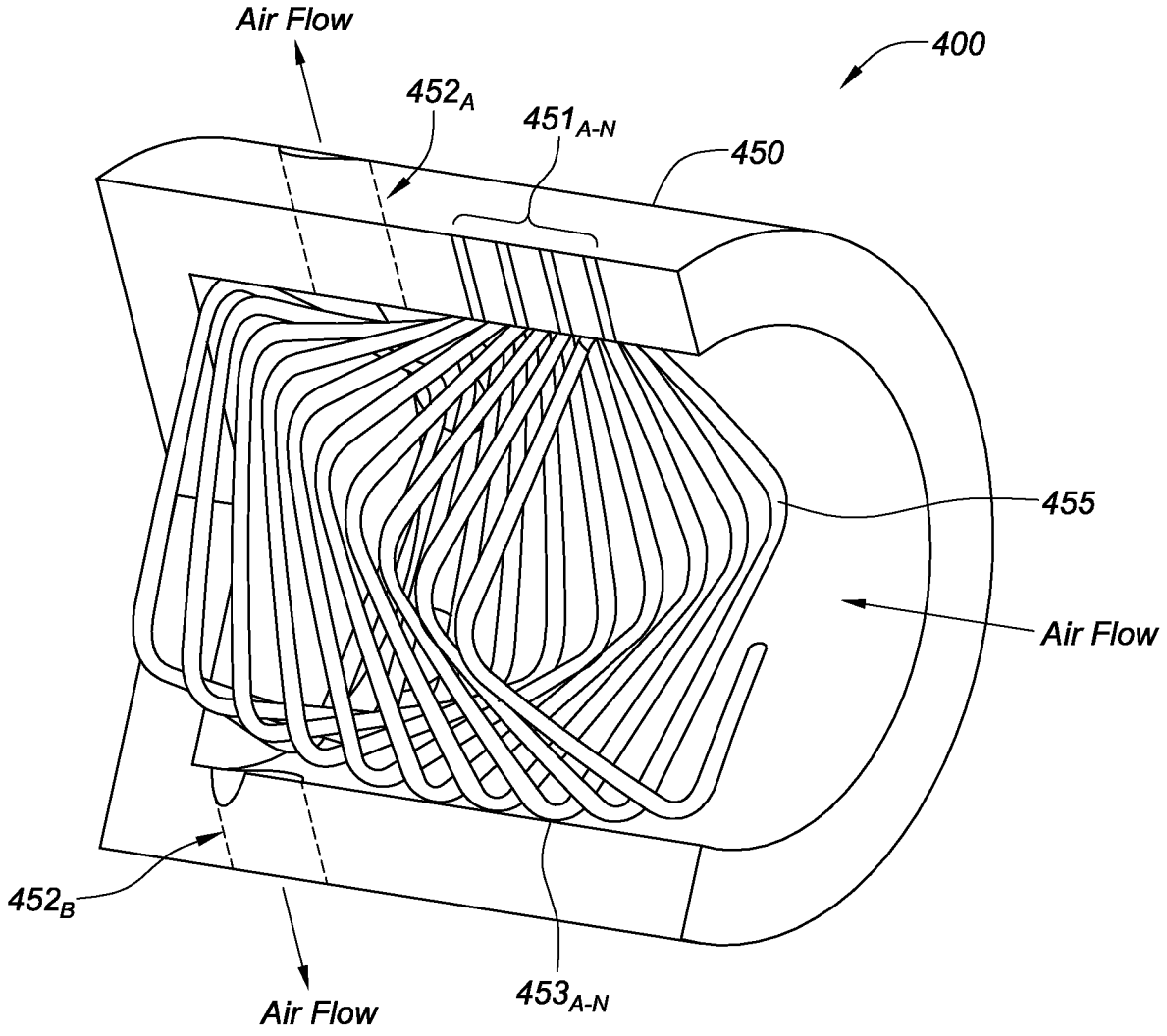
FIG. 4 is a cross-sectional side view of an atomizer for an electronic cigarette, consistent with various aspects of the present disclosure.

FIG. 4 is a cross-sectional side view of an atomizer 400 of an electronic cigarette, consistent with various aspects of the present disclosure. The atomizer 400 facilitates vaporing eCig juice into an air stream. Oscillating diaphragm pumps, as disclosed herein, deliver eCig juice from a eCig juice tank to solution apertures $\mathbf{451}_{A\text{-}N}$ that are distributed about a cylindrical frit 450. The eCig juice is pumped through the solution apertures $\mathbf{451}_{A\text{-}N}$ and into contact with heating element 455 via heating element contact points $\mathbf{453}_{A\text{-}N}$. When an electrical current is driven through the heating element 455, the eCig juice thereon warms until reaching a vaporization temperature. Once vaporized, the vaporized eCig juice is drawn into an air flow (to create an aerosol) that is drawn out of the frit 450 via aerosol exit apertures $\mathbf{452}_{A\text{-}B}$ which deliver the aerosol to a user's mouth.

Aspects of atomizer 400 are directed to a heating element 455 that is a square helix. The square helix minimizes heating element contact points $\mathbf{453}_{A\text{-}N}$ with frit 450. In various embodiments of the present disclosure, it is desirable to minimize contact between the frit 450 and the heating element 455. By minimizing contact, the drive current required to vaporize eCig juice on the heating element is reduced. Specifically, less heating energy is lost to the frit 450, and accordingly battery life of the eCig is improved. However, positioning the heating element 455 in close proximity to the frit 450 is also desirable to facilitate eCig juice transmission from the solution apertures $\mathbf{451}_{A\text{-}N}$ of the frit 450 to the heating element 455.

In various embodiments of an eCig consistent with the present disclosure, it is desirable to aerosolize a large amount of eCig juice (e.g., up to 5 mg/sec) while maintaining a small form factor eCig. Existing eCig designs facilitate aerosolizing up to 2 mg/sec of eCig juice by dispensing the eCig juice directly onto a heating element by pumping it out of a stainless steel needle onto either an interior or exterior surface of the heating element. At amounts greater than 2 mg/sec, the heating element may become saturated with eCig juice (unless the heating element is made larger, which may be impractical due to size and electrical current usage constraints). This saturation may cause some of the eCig juice to be boiled off, leading to splattering of the eCig juice onto an interior surface of the airway. Aspects of the present disclosure solve such problems by dispensing eCig juice through one or more apertures extending through the frit and onto the heater element. To further facilitate vaporization of eCig juice on the heating element, the air that is drawn into the atomizer chamber is directed through the middle of the heating element. In some specific embodiments, a glass or ceramic frit may be used to dispense the eCig juice onto the heating element. In other embodiments, a small, ceramic-coated steel tube with apertures may be used to dispense the eCig juice onto the heating element. In yet other embodiments, a glass airway with apertures may be used to dispense the eCig juice onto the heating element.

In various embodiments of the present disclosure, the heating element may be held against the wall of the frit/steel/glass tube, or in close proximity (e.g., within 0.5 millimeters ("mm") and preferable within 0.25 mm) from the inner wall of the tube. Such embodiments decrease and/or preclude splattering of the eCig juice during vaporization. However, one drawback of such an embodiment is that the close proximity of the heating element to the frit requires more electrical power due to energy loss to the frit. Aspects of the present disclosure address this issue through the use of unique heating element shapes that further reduce heating element contact with the frit.

Figure 5:
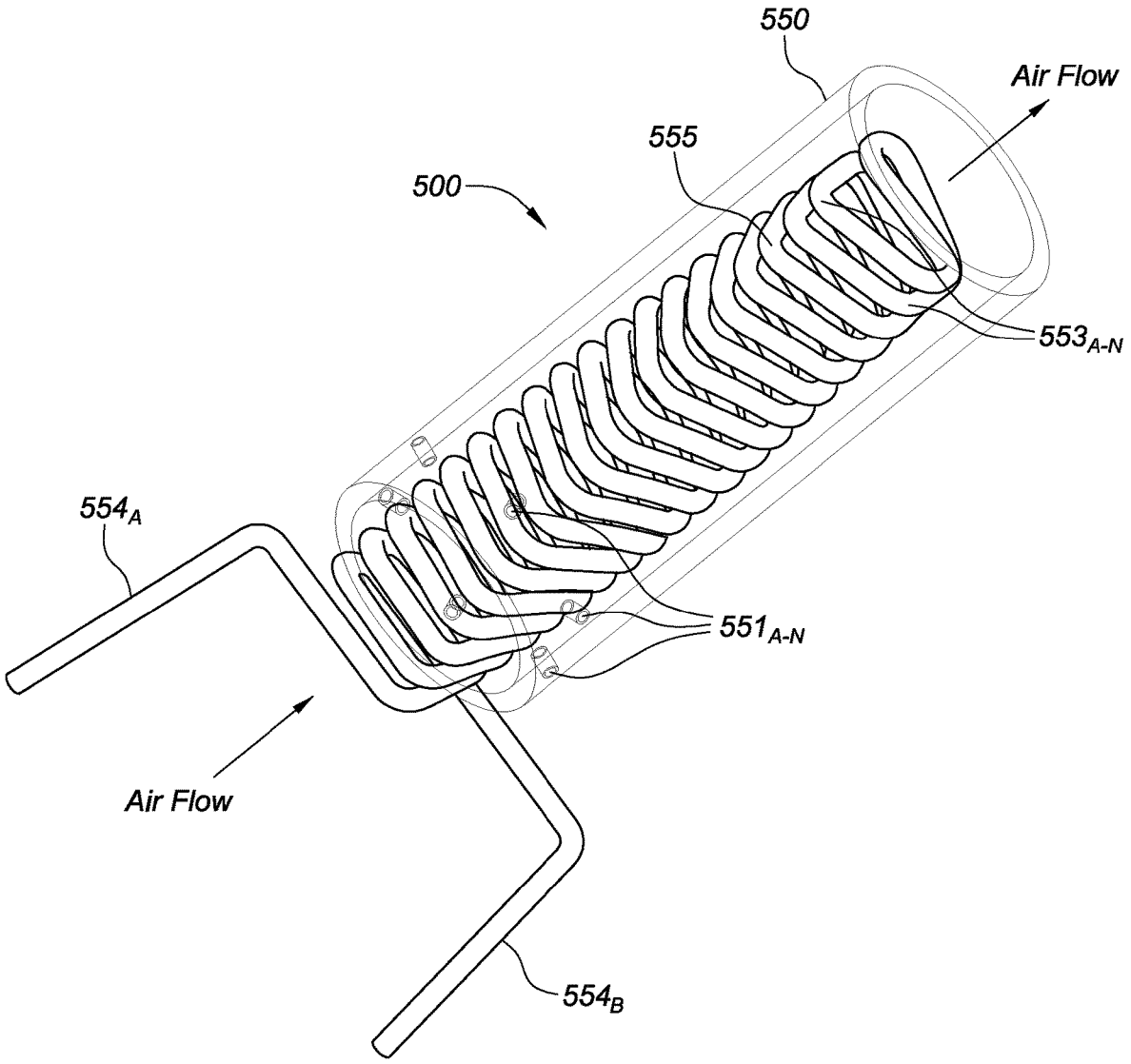
FIG. 5 is an isometric side view of an atomizer of an electronic cigarette, consistent with various aspects of the present disclosure.

FIG. 5 is an isometric side view of an atomizer 500 of an electronic cigarette. The atomizer 500 includes a heating element 555 placed within a frit 550. In the present embodiment, the frit 550 may be a steel or glass tube, and facilitates the flow of air over the heating element 555. The heating element 555 is a triangularly-shaped helix that minimizes the contact between the heating element coils and the frit 550. Specifically, for each winding of the heating element 555, there are only three heating element contact points $\mathbf{553}_{A\text{-}N}$. As discussed above, minimizing the contact points between the heating element 555 and the frit 550 reduces the energy draw required on the battery to vaporize eCig juice on the heating element. In the present embodiment, to facilitate airflow through the frit 550, and to facilitate electrical coupling of the heating element 555 to driver circuitry, lead wires $\mathbf{554}_{A\text{-}B}$ exit on the same end of the atomizer 500. Moreover, it has been discovered that assembling the atomizer 500 in such a way as to position the lead wires $\mathbf{554}_{A\text{-}B}$ to exit the upwind end of the atomizer also exhibits improved performance.

In FIG. 5, solution apertures $\mathbf{551}_{A\text{-}N}$ are circumferentially distributed about frit 550. In the present embodiment, the solution apertures $\mathbf{551}_{A\text{-}N}$ are unevenly distributed near an upwind portion of atomizer 500. However, other embodiments may more evenly distribute such solution apertures $\mathbf{551}_{A\text{-}N}$ about a length of the frit 550. When an oscillating diaphragm pump, as disclosed herein, is operating, eCig juice is pumped through the solution apertures $\mathbf{551}_{A\text{-}N}$ in the frit 550 and into contact with heating element 555 via heating element contact points $\mathbf{553}_{A\text{-}N}$. In various embodiments, it is desirable to vaporize eCig juice at a downwind end of the atomizer 500, relative to a user's mouth, to facilitate consistency of the aerosol density per unit volume of air delivered to the user.

Figure 5A:
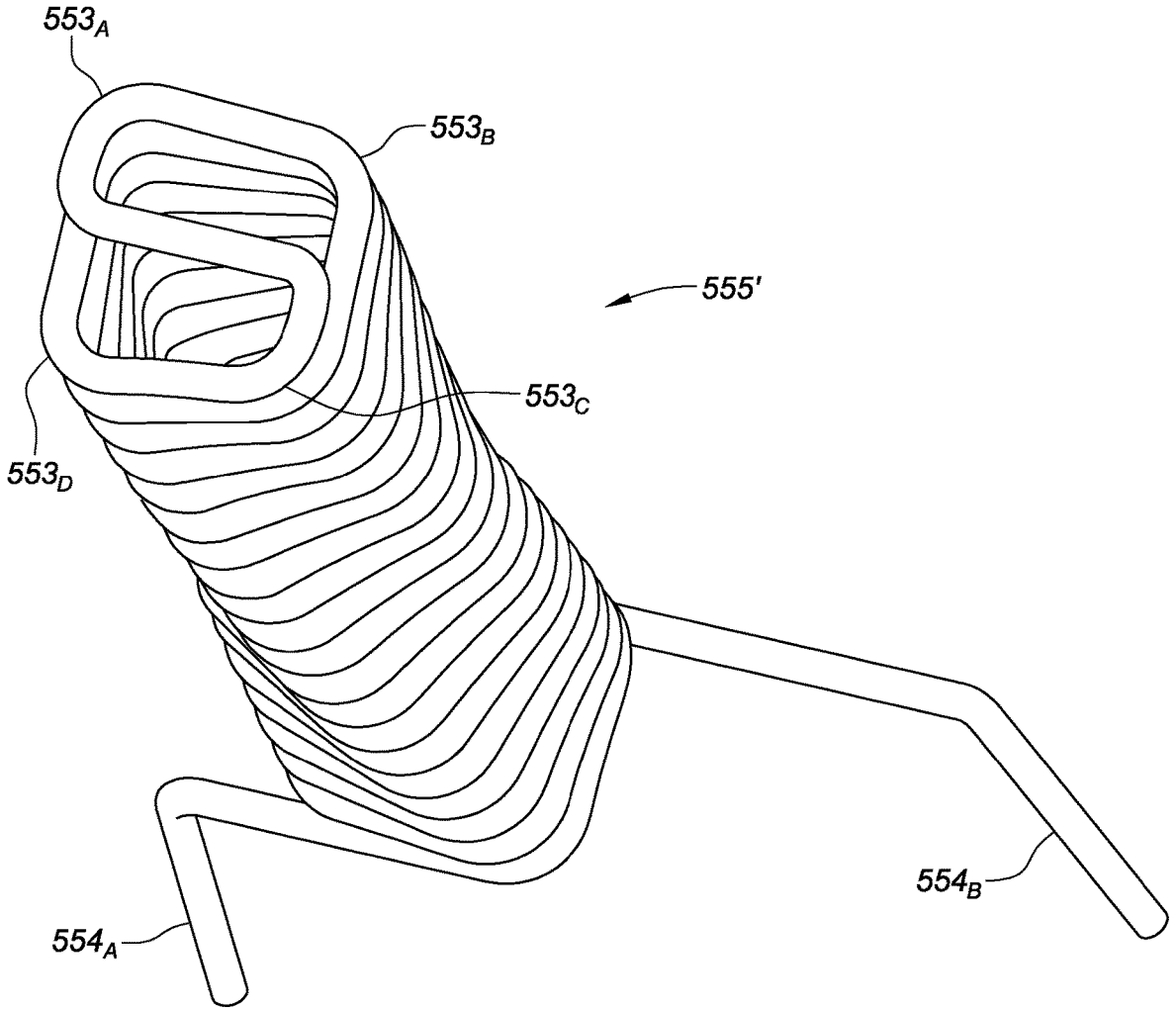
FIG. 5A is an isometric front view of an alternative heating element for the atomizer of FIG. 5, consistent with various aspects of the present disclosure.

FIG. 5A is an isometric front view of an alternative heating element 555 of the atomizer of FIG. 5, consistent with various aspects of the present disclosure. The heating element 555' of FIG. 5A is a square helix with two lead wires $\mathbf{554}_{A\text{-}B}$ extending from a distal end of the heating element. Each winding of the heating element 555' includes 4 contact points $\mathbf{553}_{A\text{-}D}$, respectively. The contact points $\mathbf{553}_{A\text{-}D}$ facilitate the flow of eCig juice from a frit surrounding the heating element 555', to the heating element itself for vaporization, while also limiting electrical loss through the frit.

Figure 5B:
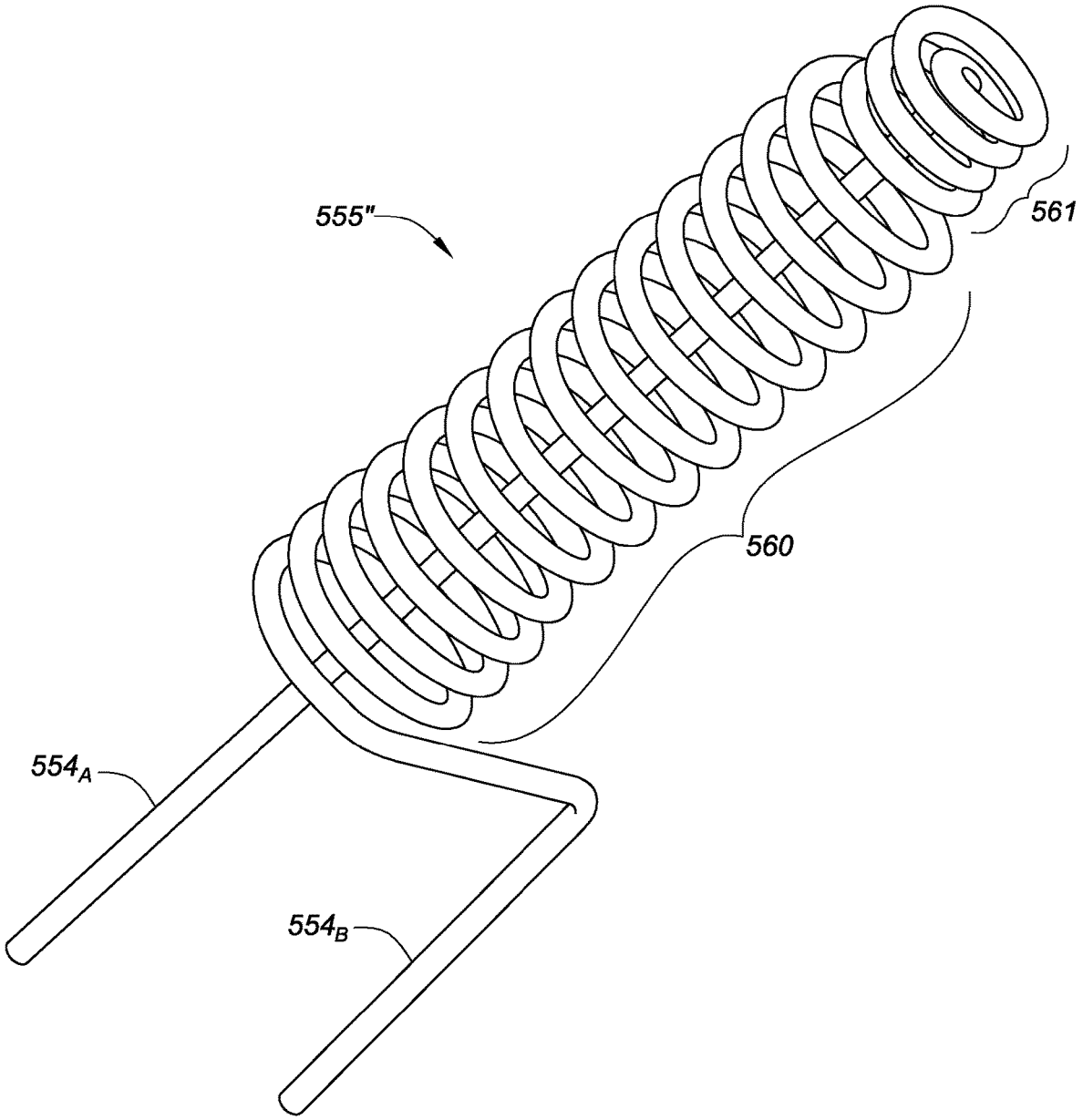
FIG. 5B is an isometric front view of another alternative heating element for the atomizer of FIG. 5, consistent with various aspects of the present disclosure.

FIG. 5B is an isometric front view of another alternative heating element 555" for the various electronic cigarettes disclosed herein. The heating element 555" has a central lead wire $\mathbf{554}_{A}$ that extends along a length of a longitudinal axis of the heating element. Heating coils of the heating element wrap around the central lead wire $\mathbf{554}_{A}$ and extend to a second lead wire $\mathbf{554}_{B}$. To limit energy loss when the heating element 555" is assembled within a frit, the heating element may be positioned so that it is not in electrical contact with the frit, but close enough to facilitate eCig juice flow from the frit to the heating element. In some embodiments, the heating element 555 and frit are maintained at a separation of 0.5 mm, and more preferably within 0.25 mm.

In the heating element 555" shown in FIG. 5B, the inner diameter may be 2.5 mm and the outer diameter may be 6 mm. In some embodiments, the heating element may be between 8 and 12 mm in length.

As further shown in FIG. 5B, the coils of the heating element 555" may vary in both pitch and diameter along a length of the longitudinal axis. For example, as shown in FIG. 5B, a first portion 560 of the heating coil has a first pitch and first diameter. A second portion 561 of the heating coil has a second pitch which is less than the first pitch and a second diameter which is less than the first diameter. In yet other embodiments consistent with the present disclosure, the pitch and diameter of the heating coil may be continuously variable along a length of the coil or may include three or more portions with varying pitch and diameter characteristics.

In various embodiments consistent with the present disclosure, in order to get eCig juice to properly wet and flow along the heating element (to facilitate even distribution along the coils), a surface finish may be applied to the heating element. In some specific embodiments, ceramic coatings may be applied to the heating element. These ceramic coatings, and other surface finishes, may comprise a smooth or rough surface application. Similarly, an interior surface of the frit may also be coated to aid in wetting of the heating element. Additionally, the ceramic coating of the heating element may help preclude electrical shorting of the heating element coils to one another.

An alternative to surface finishes and coatings on the heating element is to roughen the surface of the heating element either though bead and/or sand blasting, chemical etching, knurling or sand paper application(s) to create ridges and increase the surface area. Similar to surface finishes and coating, surface roughening may aid in wetting the heating element.

An alternative heating element design may use a thin foil heater. In some embodiments, the thin foil heater may be between 6 and 25 microns thick. The thin foil heater may be made of a metal, such as stainless steel, with holes etched in the foil, and the foil wrapped to form a tube. The etched holes may be used to increase the electrical resistance of the heating element, and to aid in wetting the heating element with eCig juice.

Figure 6:
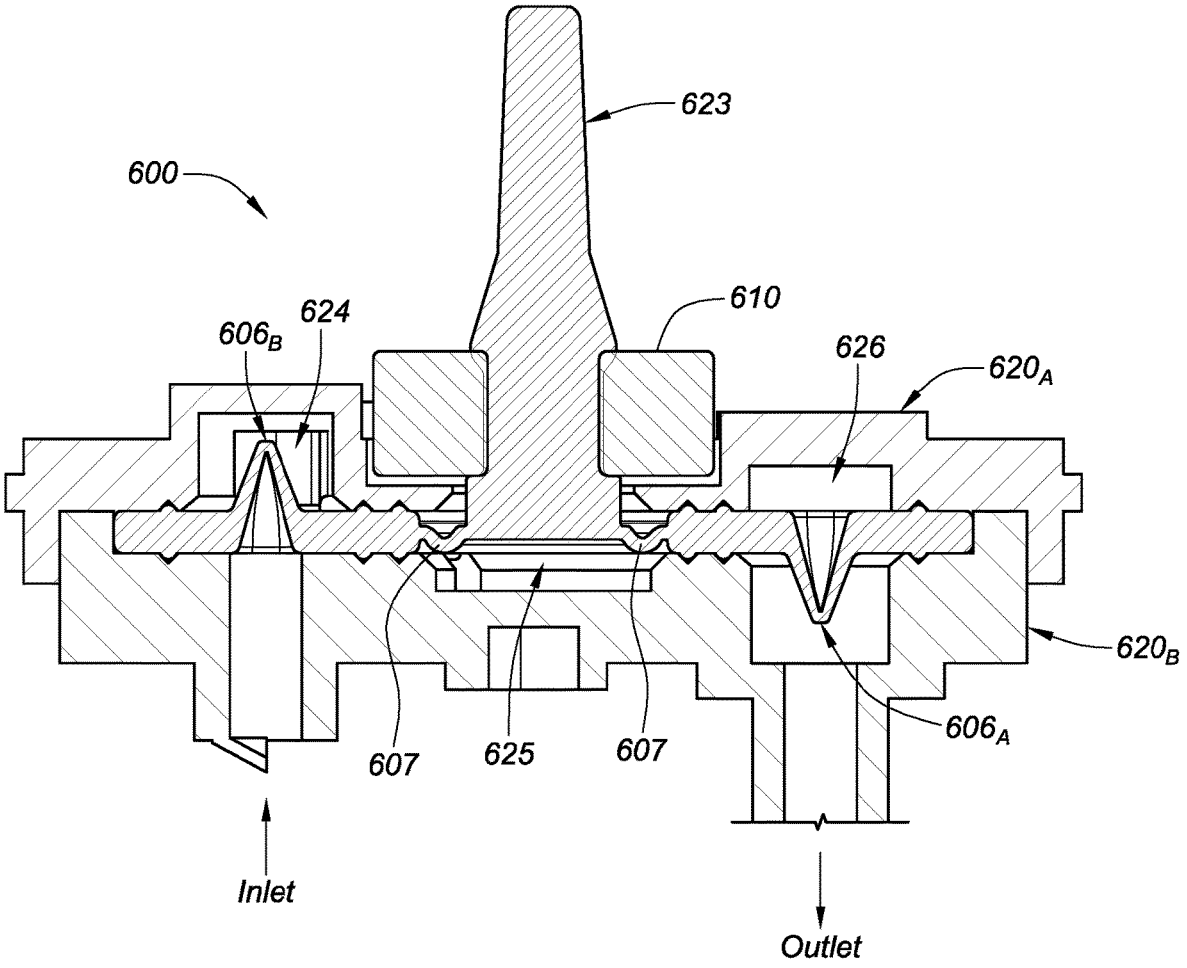
FIG. 6 is an cross-sectional side view of an oscillating diaphragm pump for an electronic cigarette, consistent with various aspects of the present disclosure.

FIG. 6 is a cross-sectional side view of an oscillating diaphragm pump 600 for an electronic cigarette, consistent with various aspects of the present disclosure. The oscillating diaphragm pump 600 facilitates an input and output on the same side of the pump. Such a configuration enables novel eCig design configurations—such as eCig juice tank mating to the pump from the same side as an airway and a mouthpiece.

In FIG. 6, eCig juice from a tank enters the oscillating diaphragm pump 600 from an Inlet. An inlet valve $\mathbf{606}_B$ acts as a one-way valve that draws eCig juice from the tank into an inlet chamber 624 in response to a vacuum pressure within the inlet chamber 624. Once the inlet chamber 624 has reached an equilibrium pressure with the eCig tank, the inlet valve $\mathbf{606}_B$ closes, with a portion of the inlet chamber 624 filled with eCig juice. The vacuum pressure in the inlet chamber 624 is caused by a change in volume of a diaphragm 625. The oscillating diaphragm pump 600, in response to an oscillating magnetic field, linearly actuates an oscillator 623 which is coupled to a permanent magnet 610 which the oscillating magnetic field acts on. When the magnetic field causes an expansion of the diaphragm 625, the inlet chamber 624 is placed into a vacuum pressure to open the inlet valve $\mathbf{606}_B$ (as discussed above); simultaneously, the vacuum pressure causes outlet valve $\mathbf{606}_A$ to close preventing a flow of eCig juice from an outlet chamber 626 out through the Outlet.

When the magnetic field repels the permanent magnet 610, the diaphragm 625 contracts, creating a positive pressure in the inlet chamber 624 which closes the inlet valve $\mathbf{606}_B$, while similarly creating a positive pressure in the outlet chamber 626 that opens the outlet valve $\mathbf{606}_A$ facilitating a flow of eCig juice from the outlet chamber 626 through the Outlet (and into an atomizer).

Where the diaphragm 625 is expanded at a deformable membrane 607, eCig juice within the inlet chamber 624 is drawn into the diaphragm 625. Where the diaphragm 625 is contracted at the deformable membrane 607, eCig juice within the diaphragm flows into the outlet chamber 626 (due to the lower pressure within the outlet chamber 626 compared to inlet chamber 624). The oscillating diaphragm pump 600 may be driven by a magnetic field with variable voltage and frequency to adjust the pumping rate of the pump. Moreover, the diaphragm 625 travel length may be adjustable or designed with a specific travel length to suit a specific pumping application. For example, in applications where high flow rates to the atomizer are desirable, the travel length of the diaphragm 625 may be longer (e.g., 0.05 inches), and/or the voltage or frequency of the oscillating magnetic field may be adjusted.

Figure 6A:
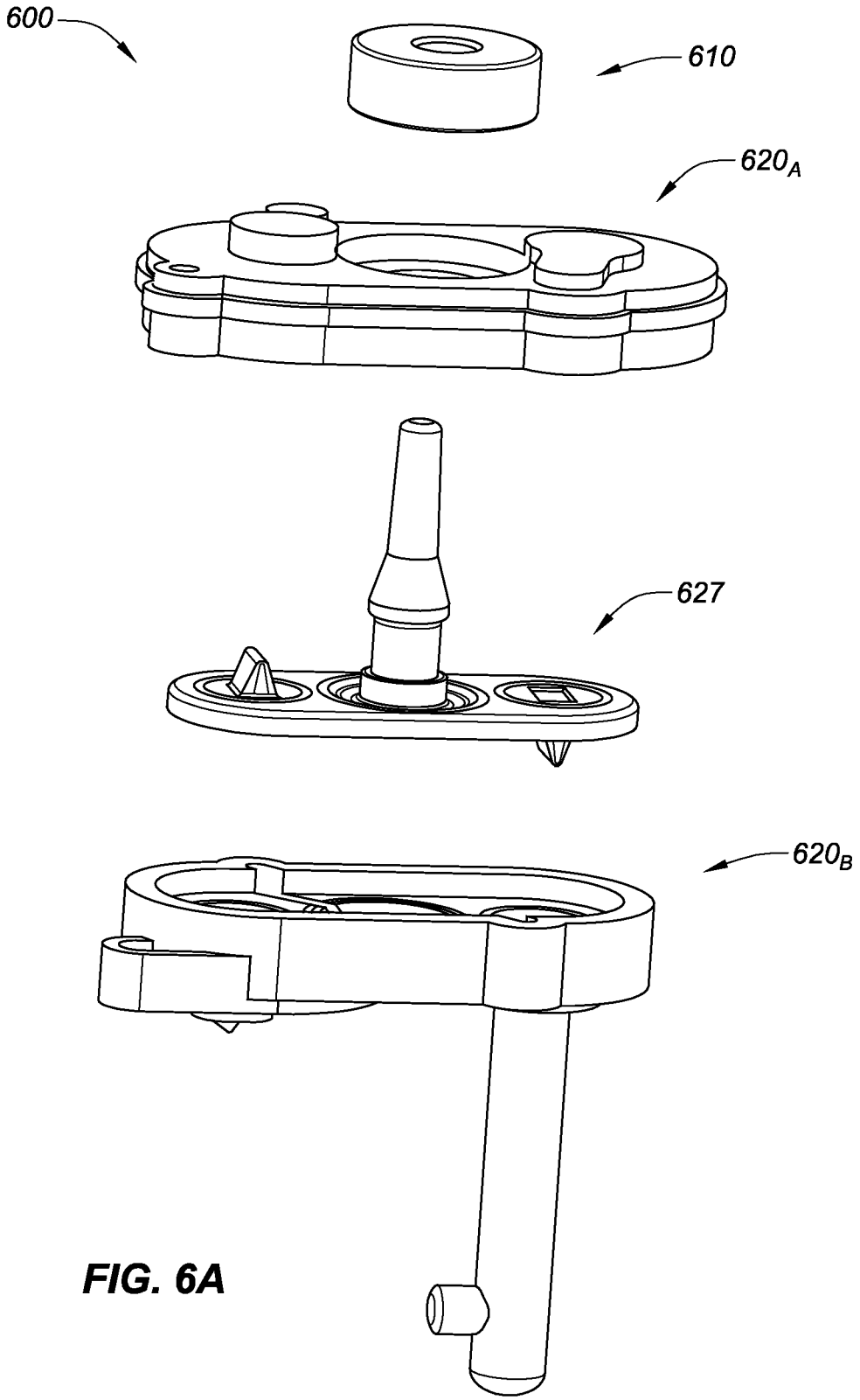
FIG. 6A is an exploded isometric side view of the oscillating diaphragm pump of FIG. 6, consistent with various aspects of the present disclosure.

FIG. 6A is an exploded isometric view of the oscillating diaphragm pump 600 of FIG. 6, consistent with various aspects of the present disclosure. An inner assembly 627 of the pump is sandwiched between an upper mount $\mathbf{620}_A$ and a lower mount $\mathbf{620}_B$, with a permanent magnet 610 coupled to a distal portion of the inner assembly 627 to facilitate linear actuation of the diaphragm. Aspects of the present disclosure are directed toward reducing cost and assembly complexity by injection molding the inner assembly 627 as a single part. Accordingly, the pump 600 is assembled with only four parts, greatly reducing assembly time and cost. Moreover, the internal components (e.g., the inner assembly 627) do not require intricate assembly as is common with pumps of similar size. In various embodiments, the upper mount $\mathbf{620}_A$ and the lower mount $\mathbf{620}_B$ may be coupled to one another via snap features, further simplifying the pump assembly 600.

Figure 7:
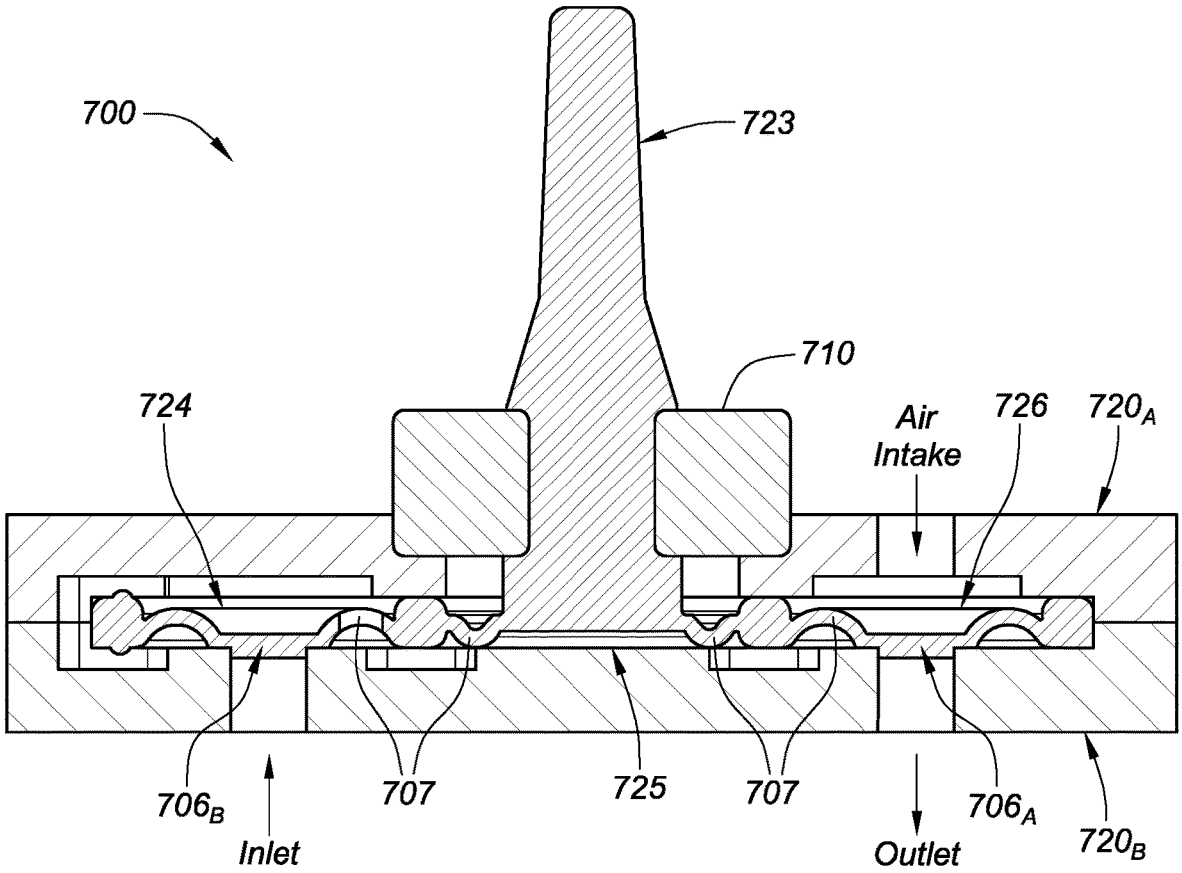
FIG. 7 is an cross-sectional side view of an oscillating diaphragm pump for an electronic cigarette, consistent with various aspects of the present disclosure.

FIG. 7 is a cross-sectional side view of an oscillating diaphragm pump 700 for an electronic cigarette, consistent with various aspects of the present disclosure. In FIG. 7, the duckbill valves of FIG. 6 have been replaced with an alternative valve design.

In FIG. 7, eCig juice from a tank enters the oscillating diaphragm pump 700 from an Inlet. An inlet valve $\mathbf{706}_B$ acts as a one-way valve that draws eCig juice from a tank into a diaphragm 725 in response to a vacuum pressure created within the inlet chamber 724 by the diaphragm 725. Once the inlet chamber 724 reaches an equilibrium pressure with the diaphragm 725, the inlet valve $\mathbf{706}_B$ closes, with a portion of the diaphragm 725 filled with eCig juice. The vacuum pressure in the inlet chamber 724 is caused by a change in volume of the diaphragm 725 due in part to deformable membrane 707. The oscillating diaphragm pump 700, in response to an oscillating magnetic field, linearly actuates an oscillator 723 which is coupled to a permanent magnet 710, which the oscillating magnetic field acts on. When the magnetic field causes an expansion of the diaphragm 725, the diaphragm and the inlet chamber 724, which is in fluid communication with the diaphragm, is placed into a vacuum pressure which opens the inlet valve $\mathbf{706}_B$ Simultaneously, the vacuum pressure causes the outlet valve $\mathbf{706}_A$ to close due to the air intake fluidly coupled to outlet chamber 726, preventing a flow of eCig juice from a diaphragm 725 through an outlet valve $\mathbf{706}_A$ to the Outlet.

Figure 7A:
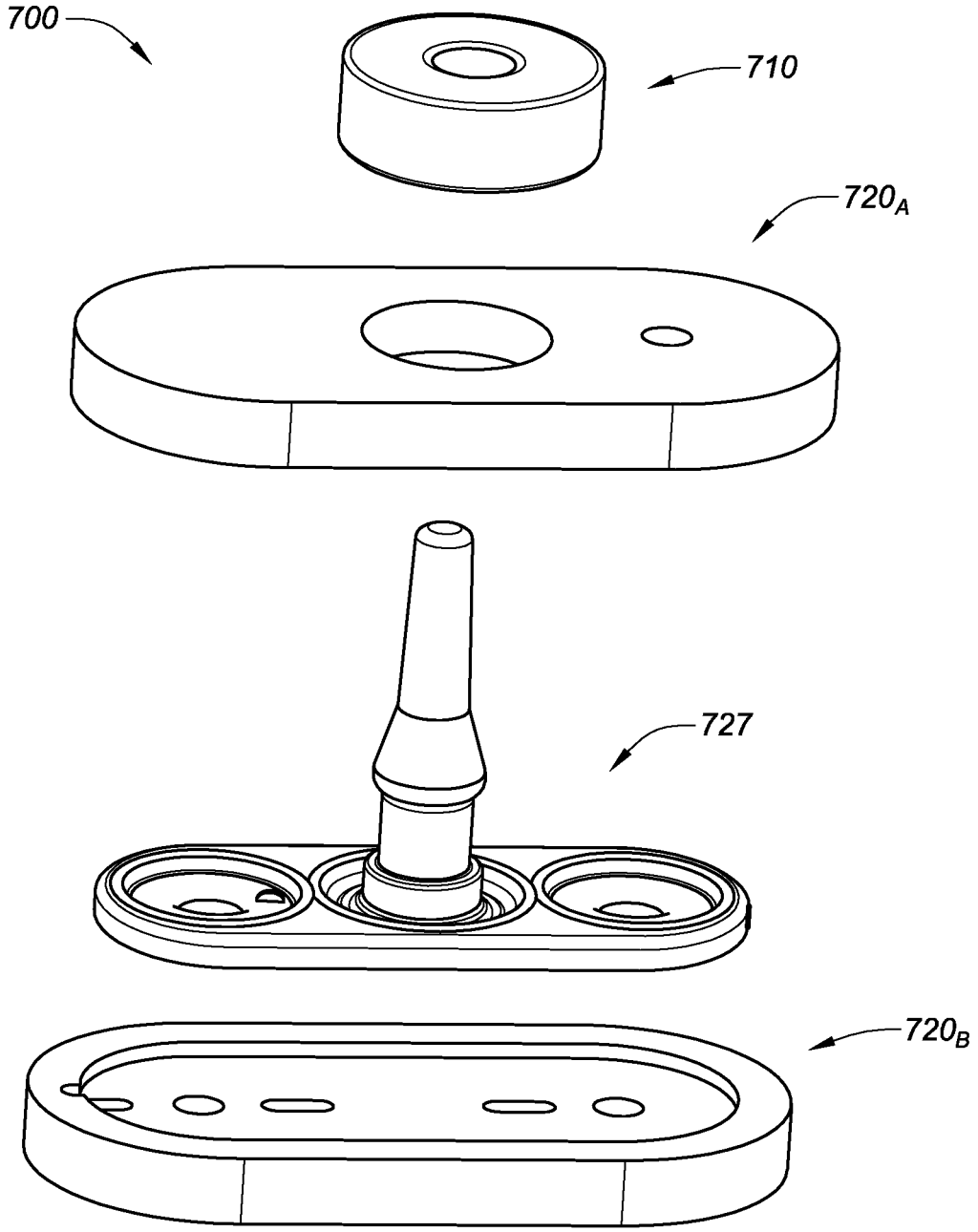
FIG. 7A is an exploded isometric side view of the oscillating diaphragm pump of FIG. 7, consistent with various aspects of the present disclosure.

FIG. 7A is an exploded isometric view of the oscillating diaphragm pump 700 of FIG. 7, consistent with various aspects of the present disclosure. An inner assembly 727 of the pump is sandwiched between an upper mount $\mathbf{720}_{A-}$ and a lower mount $\mathbf{720}_B$, with a permanent magnet 710 coupled to a distal portion of the inner assembly 727 to facilitate linear actuation of the diaphragm. Aspects of the present disclosure are directed toward reducing cost and assembly complexity by injection molding the inner assembly 727 as a single part. The inner assembly 727 may be molded from a silicone, for example, which facilitates deformation of the valves and diaphragm, in response to a pressure, but being capable of returning to a natural state once the pressure is alleviated.

Figure 7B:
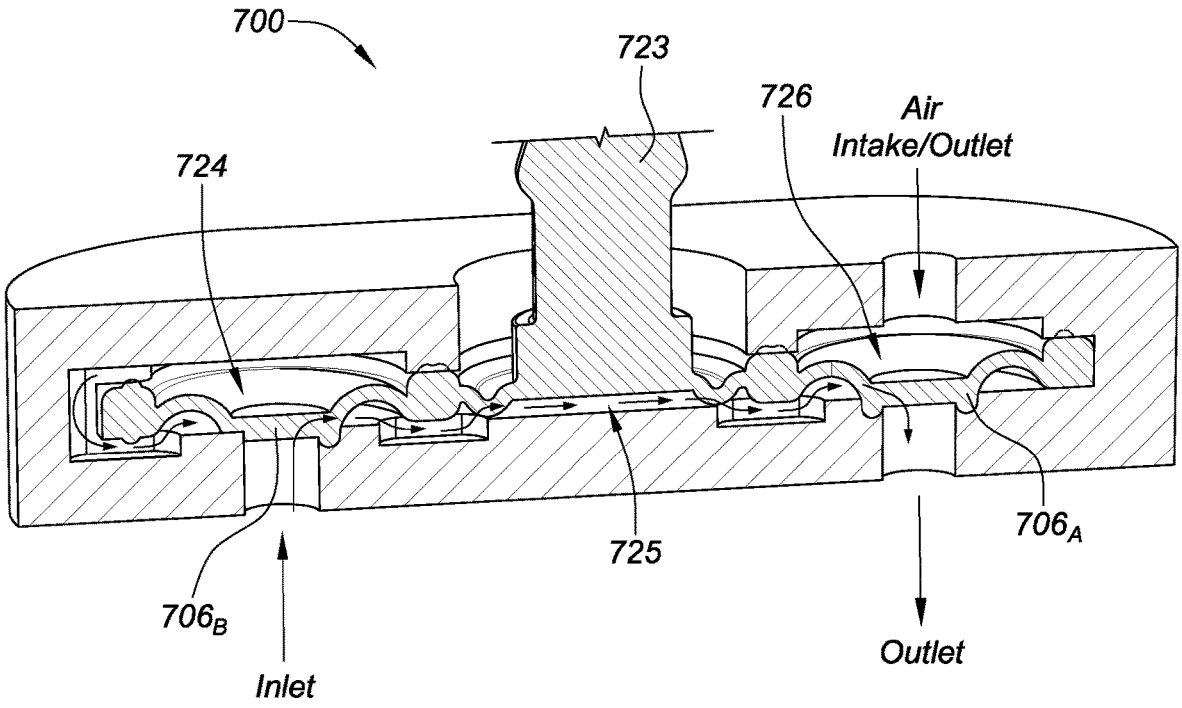
FIG. 7B is a cross-sectional side view of the oscillating diaphragm pump of FIG. 7 showing the fluid flow path during operation, consistent with various aspects of the present disclosure.

FIG. 7B is a cross-sectional side view of the oscillating diaphragm pump 700 of FIG. 7 showing the fluid flow path during operation, consistent with various aspects of the present disclosure. As shown in FIG. 7B, an oscillating diaphragm pump 700, in response to an oscillating magnetic field, linearly actuates an oscillator 723 with a permanent magnet (not shown) coupled thereto. The oscillating magnetic field acts on the permanent magnet. When the magnetic field attracts the permanent magnet, the permanent magnet draws the oscillator 723 toward the electromagnet (the pull stroke), causing an expansion of the diaphragm 725. The expansion of the diaphragm 725 creates a vacuum pressure in both the diaphragm, itself, and the fluidly coupled inlet chamber 724. The induced vacuum pressure in the inlet chamber opens inlet valve $\mathbf{706}_B$. Simultaneously, the vacuum pressure in the diaphragm 725 causes the outlet valve $\mathbf{706}_A$ to close, preventing a flow of eCig juice out through the Outlet. The outlet valve $\mathbf{706}_A$ closes due to the pressure within the diaphragm 725 being less than an ambient pressure within outlet chamber 726 as regulated by the Air Intake/Outlet.

During a push stroke of the oscillating diaphragm pump 700, a magnetic field repels the permanent magnet attached to the oscillator 723, causing the diaphragm 725 to contract. The contraction of the diaphragm 725 creates a positive pressure in the diaphragm 725 which exceeds a pressure at the Inlet. The positive pressure extends into inlet chamber 724 to close inlet valve $\mathbf{706}_B$. The positive pressure in the diaphragm 725 also exerts a positive pressure on an outlet valve $\mathbf{706}_A$ that overcomes the ambient pressure within outlet chamber 726—facilitating the flow of eCig juice from the diaphragm 725, out the outlet valve $\mathbf{706}_A$.

Figure 7C:
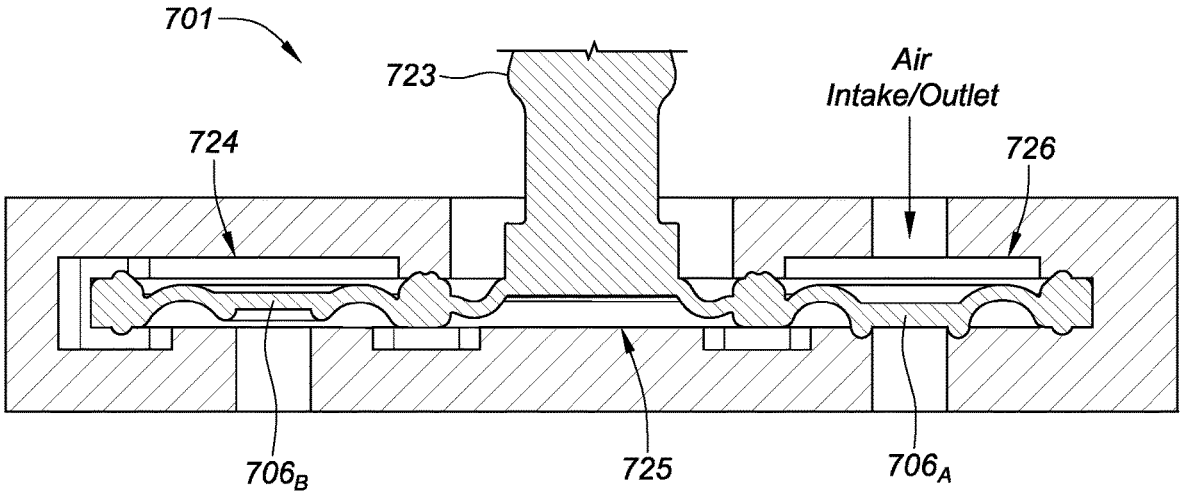
FIG. 7C is a cross-sectional side view of the oscillating diaphragm pump of FIG. 7 during a pull stroke, consistent with various aspects of the present disclosure.

FIG. 7C is a cross-sectional side view of an oscillating diaphragm pump 701 during a pull stroke, consistent with various aspects of the present disclosure. During the pull stroke of the pumping action of the oscillating diaphragm pump 701, a majority of the pumping system experiences a vacuum pressure. Specifically, a diaphragm 725 draws a vacuum and its fluid communication with inlet chamber 724 also places the inlet chamber 724 into a vacuum. The vacuum created within the inlet chamber 724 opens inlet valve $\mathbf{706}_B$ drawing eCig juice into the diaphragm 725. The vacuum pressure created by the diaphragm also acts on the outlet valve $\mathbf{706}_A$. Specifically, the vacuum pressure, once it exceeds the opposing force (atmospheric pressure) acting on the outlet valve $\mathbf{706}_A$, closes the outlet valve $\mathbf{706}_A$ to prevent the flow of eCig juice out of the pump 701 during a pull stroke. Accordingly, the pull stroke draws eCig juice into diaphragm 725 from a tank, but does not discharge any eCig juice into an atomizer.

Figure 7D:
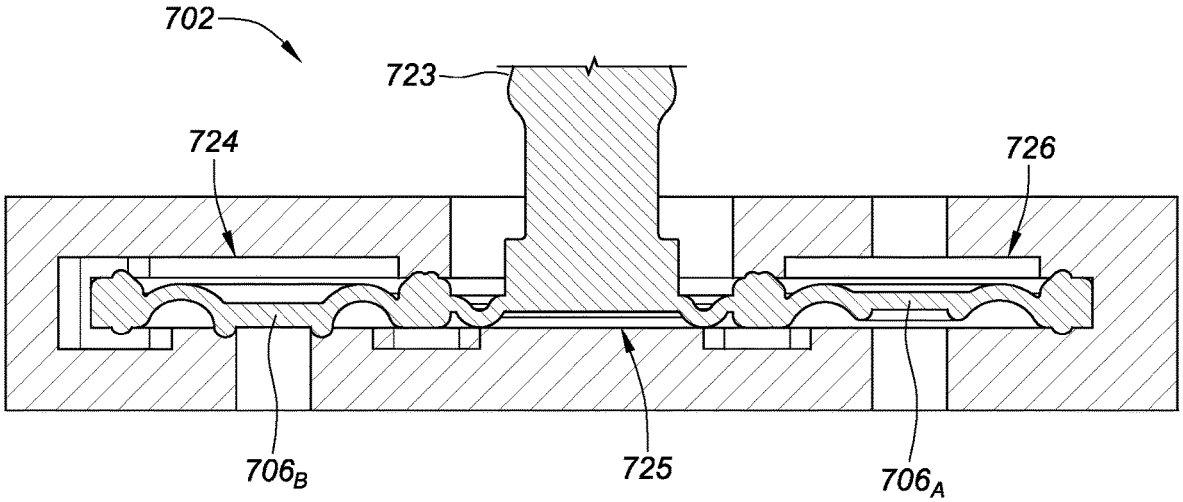
FIG. 7D is a cross-sectional side view of the oscillating diaphragm pump of FIG. 7 during a push stroke, consistent with various aspects of the present disclosure.

FIG. 7D is a cross-sectional side view of an oscillating diaphragm pump 702 during a push stroke, consistent with various aspects of the present disclosure. During the push stroke, a diaphragm 725 experiences a positive pressure. The positive pressure from the diaphragm 725 is fluidly communicated to an inlet chamber 724—causing a positive pressure therein. The positive pressure within the inlet chamber 724 overcomes the atmospheric pressure within the eCig juice tank to close inlet valve $\mathbf{706}_B$. The positive pressure is also exerted on an outlet valve $\mathbf{706}_A$. The positive pressure exerted on the outlet valve $\mathbf{706}_A$, once it exceeds an atmospheric pressure within outlet chamber 726, opens the outlet valve $\mathbf{706}_A$ and facilitates the flow of eCig juice from the diaphragm 725 into an atomizer.

Aspects of the present disclosure are directed to an electronic cigarette including a tank containing eCig juice, an atomizer, and an oscillating diaphragm pump. The atomizer includes a heating element, and vaporizes eCig juice into an airflow. The oscillating diaphragm pump includes a diaphragm and a permanent magnet. The oscillating diaphragm pump is positioned in fluid communication with the tank and the atomizer, draws eCig juice from the tank, and deposits the eCig juice on to the heating element. In further embodiments, the electronic cigarette includes an electro-magnet that transmits an oscillating magnetic field in proximity to the permanent magnet. The permanent magnet produces a non-oscillating magnetic field that interacts with the oscillating magnetic field of the electro-magnet to linearly oscillate the diaphragm which draws eCig juice from the tank and injects the eCig juice on to the heating element. In yet further embodiments, the electronic cigarette may include controller circuitry that is electrically coupled to the electro-magnet and the heating element. The controller circuitry detects a draw on the electronic cigarette. Then, in response to the draw, the controller circuitry transmits an oscillating electric signal that drives the electro-magnet, and thereby the permanent magnet of the oscillating diaphragm pump to cause eCig juice to be deposited on to the heating element. Further in response to the draw, the controller circuitry drives the heating element with a current sufficient to vaporize the eCig juice on the heating element.

In some embodiments, an oscillating diaphragm pump includes an inlet valve and an outlet valve. The inlet valve is placed in fluid communication with an inlet of the diaphragm, and the outlet valve is placed in fluid communication with an outlet of the diaphragm. The inlet and outlet valves prevent reverse flow of the eCig juice through the oscillating diaphragm pump. In more specific embodiments, the oscillating diaphragm pump further includes an upper housing and a lower housing. The upper housing contains the outlet valve, the lower housing contains the inlet valve, and at least one of the upper and lower housing includes a support member circumferentially extending around at least a portion of one or both of the inlet and outlet valves. The support member stiffens one or both of the inlet and outlet valves and reduces back flow.

An oscillating diaphragm pump, in accordance with the present disclosure, may include a deformable membrane that facilitates expansion and contraction of the diaphragm.

An atomizer of an electronic cigarette, consistent with the present disclosure, may include a frit that houses the heating element. The frit may include one or more apertures that extend through the frit, and that deliver eCig juice to the heating element. In some embodiments, the heating element is a non-circular, helical coil that minimizes contact between the heating element and the frit. In more specific embodiments, the heating element is one of a square-shaped, helical coil, and a triangle-shaped, helical coil. In yet other embodiments, the heating element is offset from an inner diameter of the frit by less than 0.25 millimeters.

In some embodiments, an atomizer of an electronic cigarette directs airflow through a cavity of the heating element, and the heating element includes a ceramic coating that facilitates wetting the heating element with eCig juice and mitigates electrical shorting of adjacent heating element coils.

In eCigs including controller circuitry, the controller circuitry may detect the strength of a draw, adjust the transmitted oscillating electric signal that drives the electro-magnet, and adjust the current delivered to the heating element to maintain a consistent vapor content per airflow volume delivered to a user.

Aspects of the present disclosure are directed to oscillating diaphragm pumps that pump eCig juice at a flow rate of up to 10 mg/sec with a pressure of approximately 0.5 psi. In some embodiments, the oscillating diaphragm pump has a diaphragm travel length between 0.03 and 0.05 inches.

Heating elements, in accordance with the present disclosure, may include a rough exterior surface that facilitates wetting the heating element with eCig juice, and mitigates electrical shorting of adjacent heating element coils.

Various embodiments of the present disclosure are directed to an oscillating diaphragm pump including a diaphragm, a permanent magnet, an inlet valve, and an outlet valve. The diaphragm includes a deformable membrane, an inlet, and an outlet. The diaphragm expands and contracts, and thereby pumps a liquid solution through the oscillating diaphragm pump. The permanent magnet is coupled to the diaphragm, and produces a non-oscillating magnetic field that interacts with an oscillating magnetic field to sequentially attract and repel the permanent magnet, thereby expanding and contracting the diaphragm at the deformable membrane. The inlet valve is in fluid communication with the inlet of the diaphragm, and the outlet valve is in fluid communication with the outlet of the diaphragm. The inlet and outlet valves prevent reverse flow of the liquid solution through the oscillating diaphragm pump. In more specific embodiments, the pump includes an upper housing and a lower housing, the upper housing contains the outlet valve and the lower housing contains the inlet valve. At least one of the upper and lower housing includes a support member that circumferentially extends around at least a portion of one or both of the inlet and outlet valves. The support member stiffens one or both of the inlet and outlet valves to reduce back flow.

This application claims the benefit of U.S. application Ser. No. 14/092,405, filed 27 Nov. 2013 (the '405 application), now pending. This application also claims the benefit of U.S. application Ser. No. 14/168,338, filed 30 Jan. 2014 (the '338 application), now pending. The '405 application and the '338 application are both hereby incorporated by reference as though fully set forth herein.

Specific/Experimental Results

Figure 8:
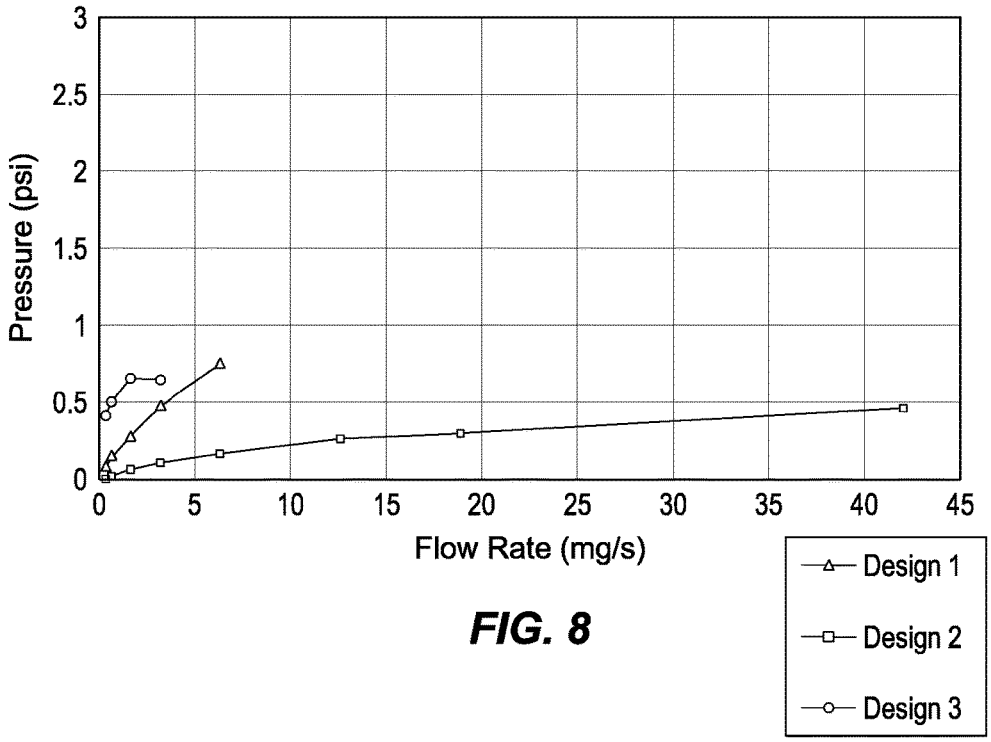
FIG. 8 is a graph showing the operational characteristics of various oscillating diaphragm pump designs consistent with the present disclosure.

Specific/experimental oscillating diaphragm pumps have been developed that are capable of maintaining a flow rate through a valve of the pump at a desired pressure. In various applications, the upper requirement of pumping is 10 mg/sec, as the pump is only "pumping" half the time, (the other half of the time the pump is refilling). In various eCig applications, it is desirable for the flow rate to be established at a low pressure—which minimizes the current (power) draw from a battery source required to drive the magnet back and forth, and thereby power the pump. In various embodiments consistent with the present disclosure, the electromagnetic pump system generates a force of approximately 10 grams. If the cross-sectional area of the pump that is oscillating back and forth is 6 $mm^2$, the resulting pressure is approximately 0.5 PSI (pounds per square inch). In such an embodiment, the pump functions at a flow rate of 10 mg/sec, with a pressure that is less than 0.5 PSI. A number of materials and shapes of the valve were tested. FIG. 8 is a graph with some example testing results—where the x-axis is pump flow rate in mg/sec, and the y-axis is pump pressure in PSI. As shown in FIG. 8, many of the oscillating diaphragm pump designs disclosed herein exhibit ideal characteristics—a large flow rate range that maintains a low pump pressure across the flow rate range (e.g., in some embodiments, at or below 0.5 PSI).

The deformable membrane of an oscillating diaphragm pump material may comprise Silpak P/N R2128 (a proprietary, low viscosity silicone RTV rubber manufactured by Silpak, Inc.), or a composition including Silpak P/N R2128. In yet other embodiments, the deformable membrane of an oscillating diaphragm pump material may comprise a material or a composition of materials with similar material characteristics to Silpak P/N R2128, such as another silicone rubber composition or other deformable material. The oscillating diaphragm pump including Silpak P/N R2128 (denoted as "Design 3" in FIG. 8), as tested, maintained a pressure under 0.5 PSI for a flow rate range between 0-45 mg/s.

Figure 9:
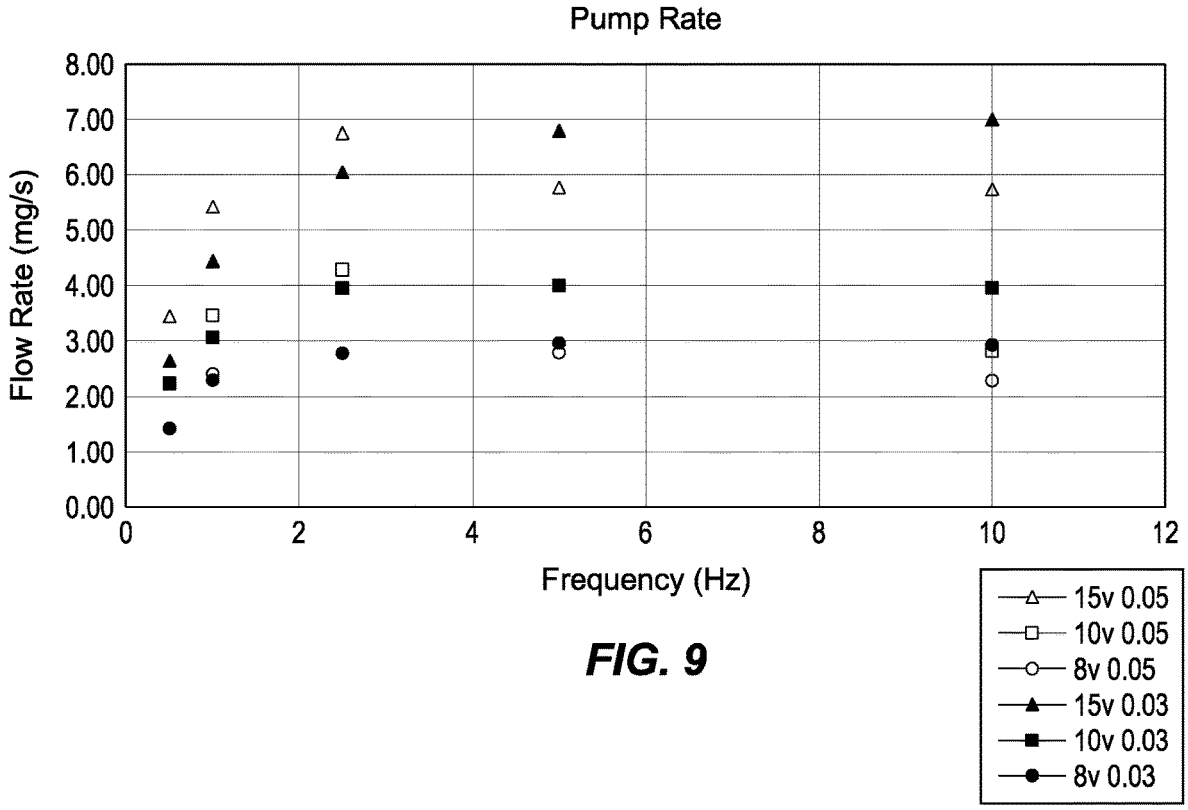
FIG. 9 is a graph showing the flow rate of an example oscillating diaphragm pump design in response to various input conditions, consistent with the present disclosure.

FIG. 9 is a graph showing the flow rate of an example oscillating diaphragm pump design in response to various input conditions, consistent with the present disclosure. The varying input conditions include varying drive voltages (power), varying pump (oscillation) frequencies (x-axis), and two different diaphragm travel lengths (0.03 inches and 0.05 inches). FIG. 9 graphs a pump rate in mg/s (y-axis) as a function of these various input conditions, and pump design aspects. As shown in FIG. 9, each of the input voltage/diaphragm travel length profiles exhibit similar characteristics. For example, several of the profiles exhibit a max flow rate at approximately 2.5 Hz. It also appears that flow rate is more closely correlated to voltage input then to diaphragm travel length. To achieve higher flow rate, the oscillating diaphragm pump may be driven by higher voltage. Also, the correlation between flow rate and oscillation frequency is greatly reduced beyond 2.5 Hz. Some of the profiles even exhibit reduced flow rate at higher oscillation frequencies (e.g., 15V/0.05" and 8V/0.05").

Based upon the above discussion and illustrations, those skilled in the art will readily recognize that various modifications and changes may be made to the various embodiments without strictly following the exemplary embodiments and applications illustrated and described herein. For example, components of the oscillating diaphragm pump may be repositioned, relative to one another, to facilitate design requirements for a specific application. Moreover, while aspects of the present disclosure have been presented in the context of oscillating diaphragm pumps, the teachings of the present disclosure may be readily applied, in view of the above, to various other types of pumps. For example, positive displacement pumps—including reciprocating, metering, rotary-type, hydraulic, peristaltic, gear, screw, flexible impeller, piston, progressive cavity pump, among others. Such modifications do not depart from the true spirit and scope of various aspects of the invention, including aspects set forth in the claims.

Various modules or other circuits may be implemented to carry out one or more of the operations and activities described herein and/or shown in the figures. In these contexts, a "module" is a circuit that carries out one or more of these or related operations/activities (e.g., controller circuitry). For example, in certain of the above-discussed embodiments, one or more modules are discrete logic circuits or programmable logic circuits configured and arranged for implementing these operations/activities. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a CPU hardware-based circuit and a set of instructions in the form of firmware, where the first module includes a first CPU hardware circuit with one set of instructions and the second module includes a second CPU hardware circuit with another set of instructions.

Certain embodiments are directed to a computer program product (e.g., nonvolatile memory device), which includes a machine or computer-readable medium having stored thereon instructions which may be executed by controller circuitry (or other electronic device) to perform these operations/activities.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The terms "including," "comprising" and variations thereof, as used in this disclosure, mean "including, but not limited to," unless expressly specified otherwise.

The terms "a," "an," and "the," as used in this disclosure, means "one or more," unless expressly specified otherwise.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

LIST OF REFERENCE SIGNS

10 electronic smoking device
12 end cap
14 power supply portion
16 atomizer/liquid reservoir portion
18 light-emitting diode (LED)
20 air inlets
22 battery
24 control electronics
26 airflow sensor
28 atomizer
30 heating coil
32 wick
34 central passage
36 liquid reservoir
38 air inhalation port
200 oscillating diaphragm pump
205 housing
206 valve
210 permanent magnet
300 electronic cigarette
301 oscillating diaphragm pump
305 housing
305$_A$ lower housing
305$_B$ upper housing
306$_A$ outlet valve
306$_B$ inlet valve
310 permanent magnet
315 electromagnet
320$_A$ upper mount
320$_B$ lower mount
321 diaphragm expansion region
322 support member
328 atomizer chamber
336 liquid reservoir
300' electronic cigarette
305' housing
305'$_A$ lower housing
305'$_B$ upper housing
306'$_A$ outlet valve
306'$_B$ inlet valve
310' permanent magnet
315' electromagnet
328' atomizer chamber
336' liquid reservoir
400 atomizer
450 frit
451$_{A-N}$ solution apertures
452$_{A-B}$ aerosol exit apertures
453$_{A-N}$ heating element contact points
455 heating element
500 atomizer
550 frit
551$_{A-N}$ solution apertures
553$_{A-N}$ heating element contact points
554$_{A-B}$ lead wires
555 heating element
555' heating element
555" heating element
560 a first heating element portion
561 a second heating element portion
600 oscillating diaphragm pump
610 permanent magnet
606$_A$ outlet valve
606$_B$ inlet valve
607 deformable membrane
610 permanent magnet
620$_A$ upper mount
620$_B$ lower mount
623 oscillator
624 inlet chamber
625 diaphragm
626 outlet chamber
627 inner assembly
700 oscillating diaphragm pump
701 oscillating diaphragm pump
702 oscillating diaphragm pump
710 permanent magnet
706$_A$ outlet valve
706$_B$ inlet valve
707 deformable membrane
710 permanent magnet
720$_A$ upper mount
720$_B$ lower mount
723 oscillator
724 inlet chamber
725 diaphragm
726 outlet chamber
727 inner assembly

What is claimed:

1. An electronic cigarette comprising:

a tank configured and arranged to contain eCig juice;

an atomizer including a heating element, and configured and arranged to vaporize eCig juice into an airflow; and an oscillating diaphragm pump including a diaphragm and a permanent magnet, the oscillating diaphragm pump is positioned in fluid communication with the tank and the atomizer, and configured and arranged to draw eCig juice from the tank and deposit the eCig juice on to the heating element;

wherein the oscillating diaphragm pump further includes an inlet valve and an outlet valve, the inlet valve in fluid communication with an inlet of the diaphragm, and the outlet valve in fluid communication with an outlet of the diaphragm, the inlet and outlet valves configured and arranged to prevent reverse flow of the eCig juice through the oscillating diaphragm pump;

wherein the oscillating diaphragm pump further includes an upper housing and a lower housing, the upper housing containing the outlet valve and the lower housing containing the inlet valve, and at least one of the upper and lower housing including a support member circumferentially extending around at least a portion of one or both of the inlet and outlet valves, the support member configured and arranged to stiffen one or both of the inlet and outlet valves and reduce back flow.

2. The electronic cigarette of claim 1, further including an electro-magnet configured and arranged to transmit an oscillating magnetic field in proximity to the permanent magnet; and the permanent magnet is configured and arranged to produce a non-oscillating magnetic field that interacts with the oscillating magnetic field of the electro-magnet to linearly oscillate the diaphragm, which draws eCig juice from the tank and injects the eCig juice on to the heating element.

3. The electronic cigarette of claim 1, wherein the oscillating diaphragm pump further includes a deformable membrane configured and arranged to facilitate expansion and contraction of the diaphragm.

4. The electronic cigarette of claim 1, wherein the atomizer is configured and arranged to direct the airflow through a cavity of the heating element; and the heating element includes a ceramic coating configured and arranged to facilitate wetting the heating element with eCig juice and to mitigate electrical shorting of adjacent heating element coils.

5. The electronic cigarette of claim 1, wherein the oscillating diaphragm pump is configured and arranged to pump eCig juice at a flow rate of up to 10 milligram/second with a pressure of approximately 0.5 pounds-per-square-inch.

6. The electronic cigarette of claim 1, wherein the oscillating diaphragm pump has a diaphragm travel length between 0.03 and 0.05 inches.

7. The electronic cigarette of claim 1, wherein the heating element includes a rough exterior surface configured and arranged to facilitate wetting the heating element with eCig juice, and to mitigate electrical shorting of adjacent heating element coils.

8. An electronic cigarette comprising:

a tank configured and arranged to contain eCig juice;

an atomizer including a heating element, and configured and arranged to vaporize eCig juice into an airflow; and an oscillating diaphragm pump including a diaphragm and a permanent magnet, the oscillating diaphragm pump is positioned in fluid communication with the tank and the atomizer, and configured and arranged to draw eCig juice from the tank and deposit the eCig juice on to the heating element;

wherein the atomizer further includes a frit that houses the heating element, the frit includes one or more apertures extending through the frit, the apertures configured and arranged to deliver eCig juice to the heating element.

9. The electronic cigarette of claim 8, wherein the heating element is a non-circular, helical coil configured and arranged to minimize contact between the heating element and the frit.

10. The electronic cigarette of claim 9, wherein the heating element is one of a square-shaped, helical coil, and a triangle-shaped, helical coil.

11. The electronic cigarette of claim 8, wherein the heating element is offset from an inner diameter of the frit by less than 0.25 millimeters.

12. An electronic cigarette comprising:

a tank configured and arranged to contain eCig juice;

an atomizer including a heating element, and configured and arranged to vaporize eCig juice into an airflow;

an oscillating diaphragm pump including a diaphragm and a permanent magnet, the oscillating diaphragm pump is positioned in fluid communication with the tank and the atomizer, and configured and arranged to draw eCig juice from the tank and deposit the eCig juice on to the heating element;

an electro-magnet configured and arranged to transmit an oscillating magnetic field in proximity to the permanent magnet; and the permanent magnet is configured and arranged to produce a non-oscillating magnetic field that interacts with the oscillating magnetic field of the electro-magnet to linearly oscillate the diaphragm, which draws eCig juice from the tank and injects the eCig juice on to the heating element;

controller circuitry electrically coupled to the electro-magnet and the heating element, the controller circuitry configured and arranged to detect a user draw strength on the electronic cigarette, in response to the detected draw strength, transmit an oscillating electric signal that drives the electro-magnet, and thereby the permanent magnet of the oscillating diaphragm pump which causes eCig juice to be deposited on to the heating element, further in response to the detected draw strength, drive the heating element with a current sufficient to maintain a consistent vapor content per airflow volume delivered to a user.

13. The electronic cigarette of claim 1, wherein the diaphragm, the inlet valve and the outlet valve are positioned coaxial to a longitudinal axis of the electronic cigarette.

14. The electronic cigarette of claim 13, further including an electro-magnet configured and arranged to transmit an oscillating magnetic field in proximity to the permanent magnet; and the permanent magnet is configured and arranged to produce a non-oscillating magnetic field that interacts with the oscillating magnetic field of the electro-magnet to linearly oscillate the diaphragm, which draws eCig juice from the tank and injects the eCig juice on to the heating element; and wherein the electro-magnet and the permanent magnet are also positioned coaxial to the longitudinal axis of the electronic cigarette.

* * * * *